US005415962A

United States Patent [19]

Kanemaru et al.

[11] Patent Number: 5,415,962

[45] Date of Patent: May 16, 1995

[54] ELECTROPHOTOGRAPHIC PHOTOSENSITIVE MEMBER, ELECTROPHOTOGRAPHIC APPARATUS USING SAME AND DEVICE UNIT USING SAME

[75] Inventors: Tetsuro Kanemaru, Tokyo; Toshihiro Kikuchi, Yokohama; Akihiro Senoo, Tokyo; Takakazu Tanaka, Toride, all of Japan

[73] Assignee: Canon Kabushiki Kaisha, Tokyo, Japan

[21] Appl. No.: 48,526

[22] Filed: Apr. 20, 1993

[30] Foreign Application Priority Data

Apr. 23, 1992 [JP] Japan ..... 4-129417
Apr. 23, 1992 [JP] Japan ..... 4-129421
Apr. 23, 1992 [JP] Japan ..... 4-129426

[51] Int. Cl.[6] ..... G03G 5/047

[52] U.S. Cl. ..... 430/59; 430/73; 430/79

[58] Field of Search ..... 430/57, 58, 73, 79, 430/59

[56] References Cited

U.S. PATENT DOCUMENTS 4,871,634 10/1989 Limburg et al. ..... 430/59

FOREIGN PATENT DOCUMENTS 0376311 7/1990 European Pat. Off. .
0449741 10/1991 European Pat. Off. .
0482884 4/1992 European Pat. Off. .

*Primary Examiner*—John Goodrow
*Attorney, Agent, or Firm*—Fitzpatrick, Cella, Harper & Scinto

[57] ABSTRACT

An electrophotographic photosensitive member is constituted by disposing a photosensitive layer on an electroconductive support. The photosensitive layer is characterized by containing a specific fluorene compound or by containing another specific fluorene compound and a specific triphenylamine compound. The photosensitive layer is suitable for providing an electrophotographic apparatus showing excellent electrophotographic characteristics such as a high photosensitivity, a good potential stability in repetitive use, a decreased transfer memory, no crack in the photosensitive layer and no crystallization of a charge-transporting material.

8 Claims, 1 Drawing Sheet

ELECTROPHOTOGRAPHIC PHOTOSENSITIVE MEMBER, ELECTROPHOTOGRAPHIC APPARATUS USING SAME AND DEVICE UNIT USING SAME

FIELD OF THE INVENTION AND RELATED ART

The present invention relates to an electrophotographic photosensitive member, particularly to an electrophotographic photosensitive member (hereinafter, sometimes referred to as "photosensitive member") having a photosensitive layer containing a specific compound.

The present invention also relates to an electrophotographic apparatus and a device unit respectively using the electrophotographic photosensitive member.

Heretofore, there have been proposed inorganic photosensitive members containing a photosensitive layer comprising an inorganic photoconductive material such as selenium, zinc oxide or cadmium as a main component. The inorganic photosensitive members have possessed fundamental properties in respect of electrophotographic characteristics to a certain degree but have encountered problems such as poor film-forming properties, a low plasticity and an expensive production cost. The inorganic photoconductive material generally has a high toxicity. Accordingly, there have been large constraints on production of the photosensitive member and handling of the inorganic photoconductive material.

On the other hand, many organic photosensitive members containing organic photoconductive materials as a main component have remedied the above drawbacks of the inorganic photosensitive members and has attracted considerable attention, thus having been proposed and also having been put into practical use in some cases. As the organic photoconductive material for use in the organic photosensitive member, there have been proposed a charge transfer complex containing an organic photoconductive material such as poly-N-vinyl carbazole and Lewis acid such as 2,4,7-trinitro-9-fluorenone. The charge transfer complex or the organic photoconductive material has been excellent in light weight properties and film-forming properties but has been inferior to the inorganic photoconductive material in respect of a sensitivity, a durability, a stability against environmental change, etc.

Thereafter, there has been proposed a photosensitive member having a laminate-type structure, wherein a photosensitive layer comprises a charge generation layer (CGL) containing a charge-generating material (CGM) such as organic photoconductive dyes or pigments and a charge transport layer (CTL) containing a charge-transporting material (CTM) (i.e., so-called "function-separation type photosensitive member"). Such a function-separation type photosensitive member has brought about a considerable improvement on a conventional photosensitive member possessing defects such as low sensitivity and poor durability.

The function-separation type photosensitive member allows a wide latitude in selecting a CGM and a CTM. As a result, it is possible to prepare readily a photosensitive member having an arbitrary characteristic.

As examples of the CGM, there have been known various materials such as azo pigments, polycyclic quinone pigments, cyanine colorants, squaric acid dyes and pyrylium salt-type colorants. In the above CGM, many azo pigments have been proposed since the azo pigments have a good light-resistance, a large charge-generating ability, easiness of synthesis, etc.

As examples of the CTM, there have been known various materials including: a pyrazoline compound as disclosed in Japanese Patent Publication (JP-B) No. 4188/1977; a hydrazone compound as disclosed in JP-B 42380/1980 or Japanese Laid-Open Patent Application (JP-A) No. 52063/1980; a triphenylamine compound as disclosed in JP-B 32372/1983 or JP-A 132955/1986; and a stilbene compound as disclosed in JP-A 151955/1979 or JP-A 198043/1983.

Characteristics required for the CTM may include:

(i) Stability against light and/or heat, (ii) Stability against ozone, NOx and nitric acid generated by corona discharge, (iii) High charge-transporting ability, (iv) Good compatibility with an organic solvent and/or a binder resin, (v) Easiness of production and inexpensive.

In recent years, however, a further improvement in a durability of the photosensitive member has been required. In order to meet the requirement, a protective layer has been formed on a photosensitive layer. Even in this instance, however, a CTL have encountered few defects such as a crack in the CTL, a crystallization of the CTL and phase separation of the CTL, thus leading to image defects.

In a reversal development system meeting a recent digitalization, a charging characteristic is different depending on transfer (i.e., occurrence of so-called "transfer memory") since a polarity of a primary charge and a polarity of a transfer charge are opposite to each other. As a result, an unevenness in an image density is readily liable to occur in a resultant image.

SUMMARY OF THE INVENTION

An object of the present invention is to provide an electrophotographic photosensitive member having a high photosensitivity and an excellent stability of electrophotographic characteristic even when used repetitively.

Another object of the present invention is to provide an electrophotographic photosensitive member having a photosensitive layer which substantially causes no crack and contains a charge-transporting material substantially free from occurrence of crystallization.

A further object of the present invention is to provide an electrophotographic photosensitive member having a decreased transfer memory.

A still further object of the present invention is to provide an electrophotographic apparatus and a device unit respectively including the electrophotographic photosensitive member.

According to the present invention, there is provided an electrophotographic photosensitive member, comprising: an electroconductive support and a photosensitive layer disposed on the electroconductive support, wherein said photosensitive layer satisfies the following condition (a) or (b):

(a) said photosensitive layer containing a fluorene compound of the following formula (1):

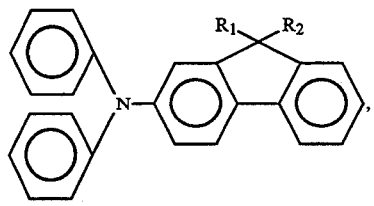

(1)

wherein $R_1$ and $R_2$ independently denote hydrogen atom, alkyl group, aryl group or aralkyl group with the proviso that $R_1$ and $R_2$ cannot be hydrogen atom simultaneously; or (b) said photosensitive layer containing a fluorene compound of the following formula (2):

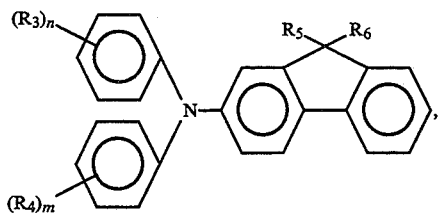

(2)

wherein $R_3$, $R_4$, $R_5$ and $R_6$ independently denote hydrogen atom or alkyl group, and n and m independently denote 1 or 2 with the proviso that $R_3$, $R_4$, $R_5$ and $R_6$ cannot be hydrogen atom simultaneously, and containing a triarylamine compound of the following formula (3) having a melting point of at most 160° C.:

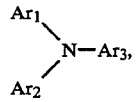

(3)

wherein $Ar_1$, $Ar_2$ and $Ar_3$ independently denote aryl group or heterocyclic group, said triarylamine compound being different from said fluorene compound of the formula (2).

According to the present invention, there is also provided an electrophotographic apparatus and a device unit including the above-mentioned electrophotographic photosensitive member.

These and other objects, features and advantages of the present invention will become more apparent upon a consideration of the following description of the preferred embodiments of the present invention taken in conjunction with the accompanying drawings.

DETAILED DESCRIPTION OF THE INVENTION

Figure 1:
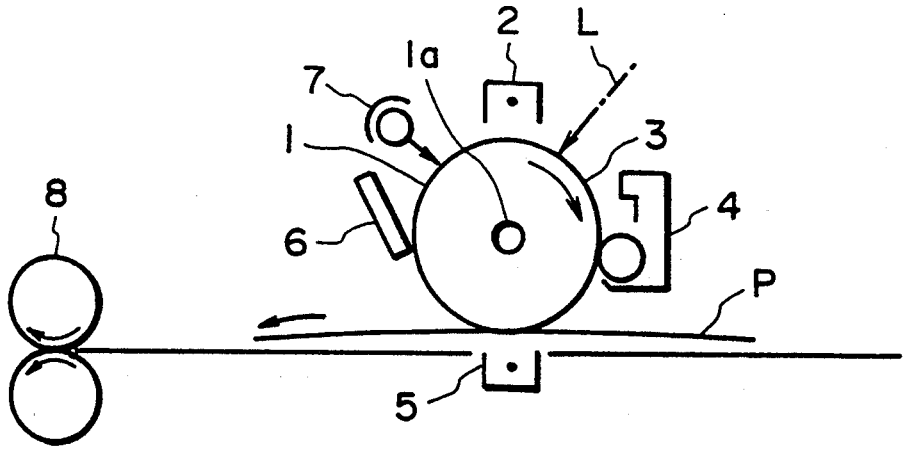
FIG. 1 is a schematic structural view of an electrophotographic apparatus using an electrophotographic photosensitive member according to the present invention.

The electrophotographic photosensitive member according to the present invention is characterized by: a photosensitive layer comprising a fluorene compound represented by the above-mentioned formula (1) or a photosensitive layer comprising a fluorene compound represented by the above-mentioned formula (2) and a triarylamine compound represented by the above-mentioned formula (3) having a melting point of at most 160° C., wherein the fluorene compound of the formula (2) is different from the triarylamine compound of the formula (3).

In the above-mentioned formulae (1) to (3), $R_1$ to $R_6$ and $Ar_1$ to $Ar_3$ may, for example, include the following specific groups. Alkyl group for the formulae (1) and (2) may include: methyl, ethyl, propyl and butyl. Aryl group for the formulae (1) and (3) may include: phenyl, naphthyl, anthryl and pyrenyl. Aralkyl group for the formula (1) may include: benzyl and phenethyl. Heterocyclic group for $Ar_1$ to $Ar_3$ of the formula (3) may include: pyridyl, thienyl, furyl and quinolyl.

In the fluorene compound of the formula (1), $R_1$ and $R_2$ may preferably be alkyl group simultaneously.

In the fluorene compound of the formula (2), $R_5$ and $R_6$ may preferably be alkyl group simultaneously. Further, when n is 2 and/or m is 2, two $R_3$ groups and/or two $R_4$ groups may be identical to or different from each other, respectively.

The triaylamine compound of the formula (3) may preferably have a melting point (m.p.) of at most 140° C. in view reducing cracks and crystallization and may more preferably be a solid at room temperature in view of drying conditions. Accordingly, the triarylamine compound of the formula (3) may particularly have a m.p. of at most 60° C.

$R_1$ to $R_6$ and $Ar_1$ to $Ar_3$ of the formulae (1) to (3) may each have a substituent. Examples of the substituent may include: alkyl group such as methyl, ethyl, propyl or butyl; aralkyl group such as benzyl, phenethyl or naphthylmethyl; aryl group such as phenyl, naphthyl, anthryl or pyrenyl; heterocyclic group such as pyridyl, thienyl, quinolyl or furyl; alkoxy group such as methoxy, ethoxy or propoxy; aryloxy group such as phenoxy or naphthoxy; halogen atom such as fluorine, chlorine, bromine or iodine; alkylthio group such as methylthio or ethylthio; arylthio group such as phenylthio or naphthylthio; amino group such as dimethylamino, diethylamino or diphenylamino; and hydroxyl group.

Hereinbelow, specific and non-exhaustive examples of the above-mentioned fluorene compounds represented by the formulas (1) and (2) may include those shown by the following structural formulas.

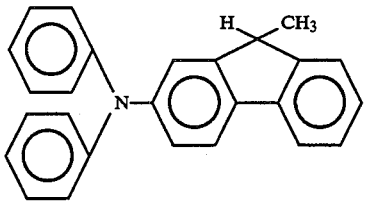

(1-1)

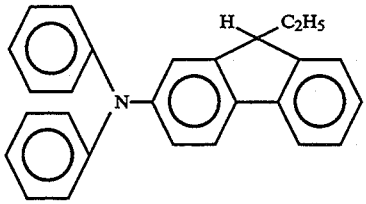

(1-2)

-continued
(1-3)
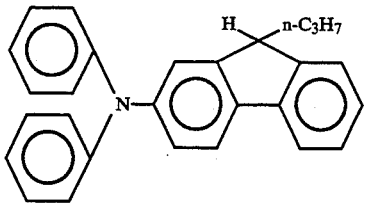
(1-4)
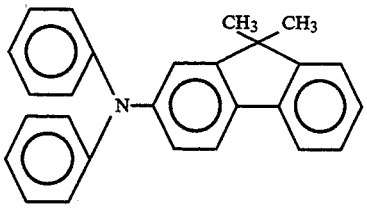
(1-5)
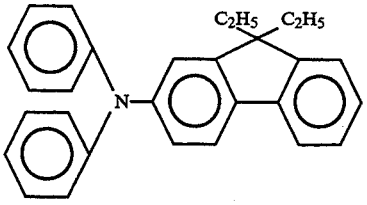
(1-6)
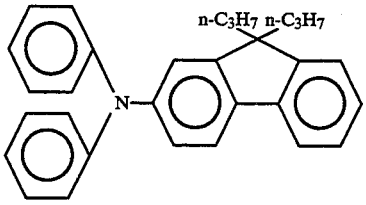
(1-7)
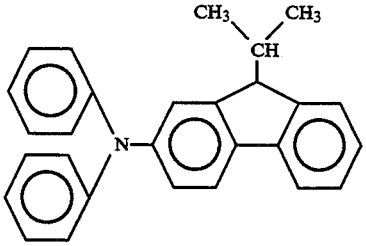
(1-8)
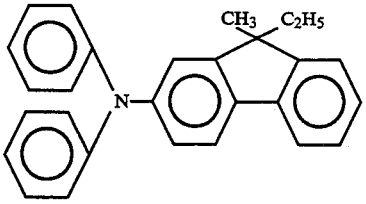
(1-9)
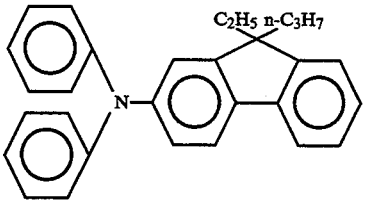
-continued
(1-10)
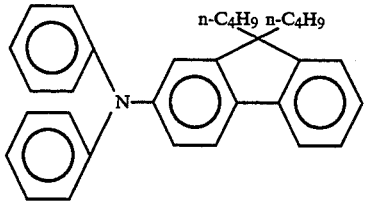
(1-11)
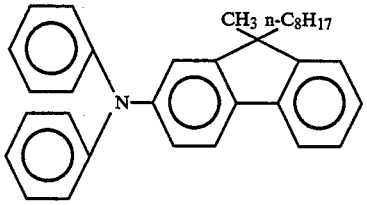
(1-12)
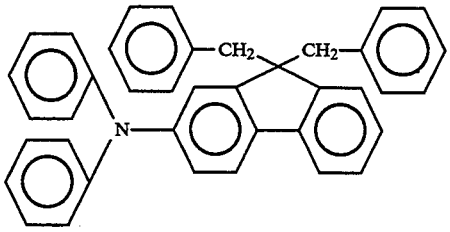
(1-13)
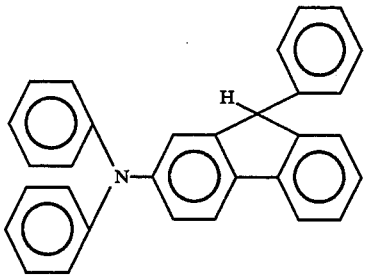
(1-14)
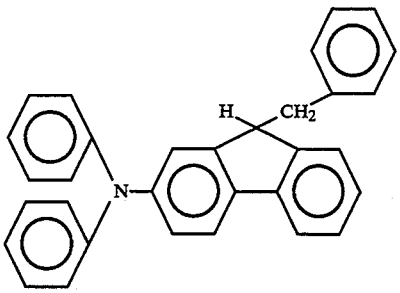
(1-15)
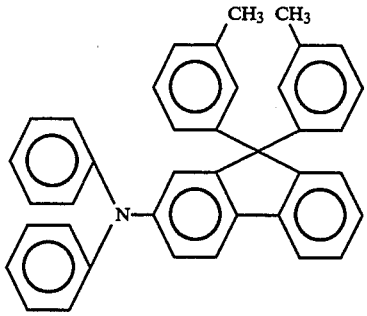

-continued
2-(1)
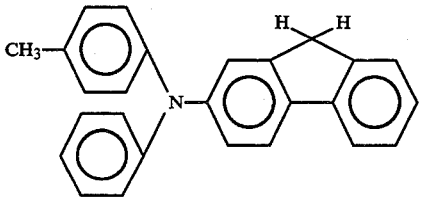
2-(2)
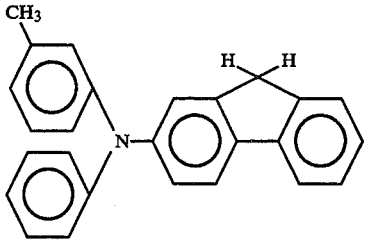
2-(3)
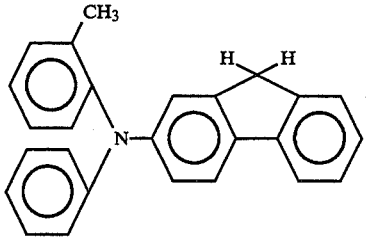
2-(4)
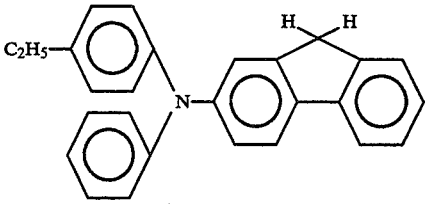
2-(5)
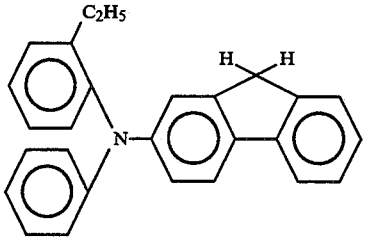
2-(6)
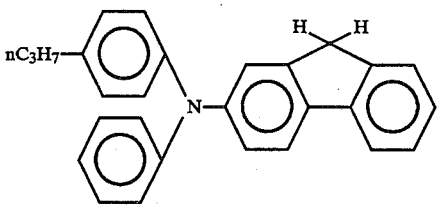
2-(7)
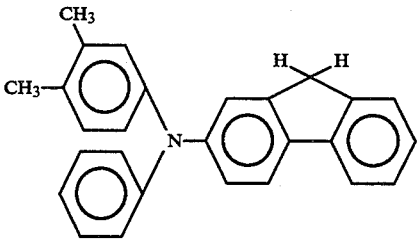
-continued
2-(8)
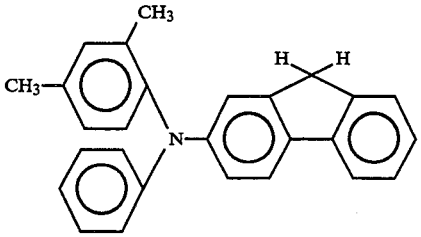
2-(9)
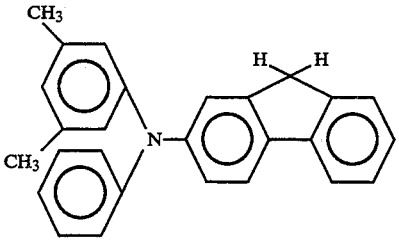
2-(10)
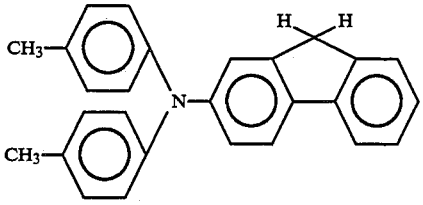
2-(11)
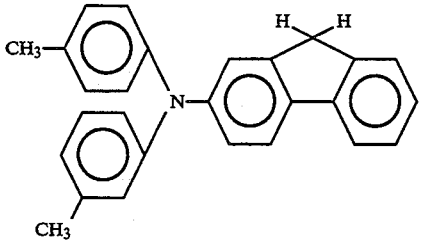
2-(12)
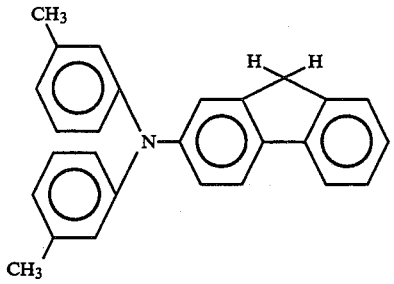
2-(13)
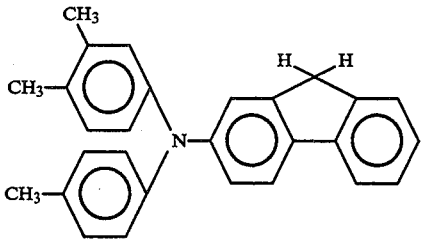

-continued
2-(14)
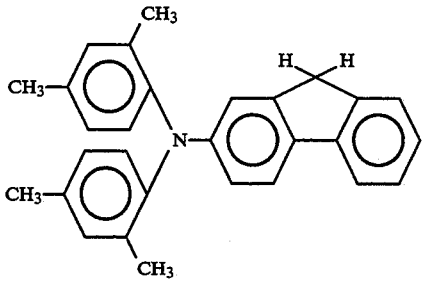
2-(15)
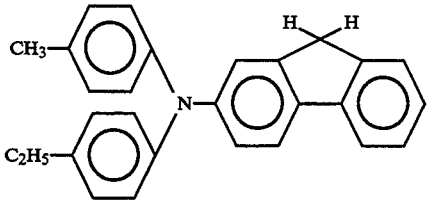
2-(16)
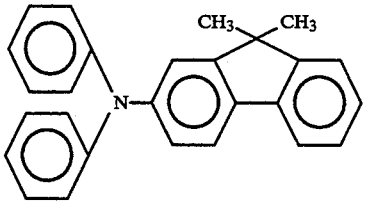
2-(17)
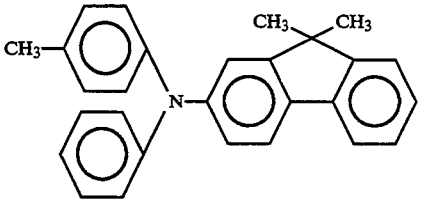
2-(18)
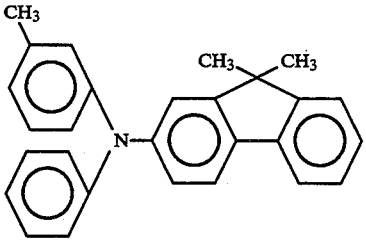
2-(19)
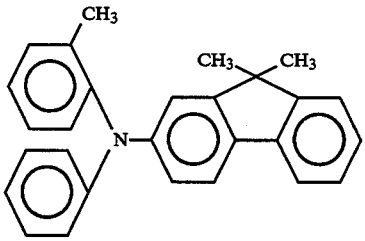
2-(20)
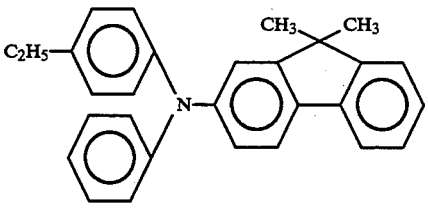
-continued
2-(21)
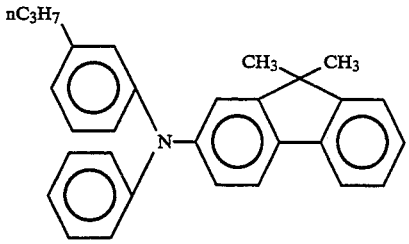
2-(22)
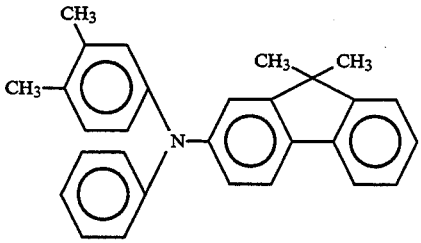
2-(23)
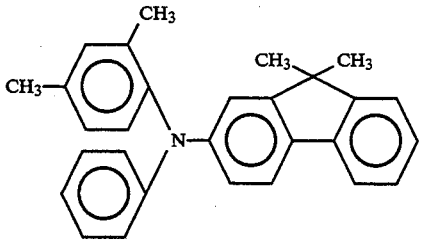
2-(24)
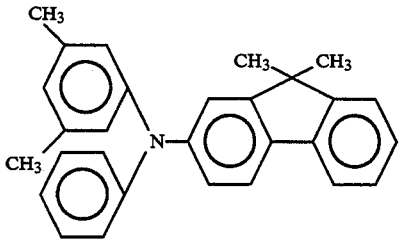
2-(25)
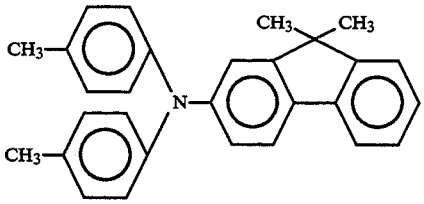
2-(26)
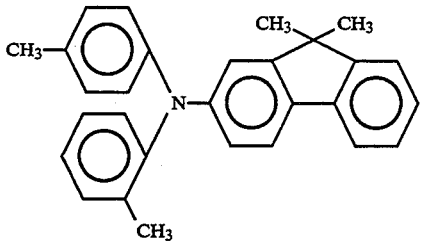

-continued
2-(27)
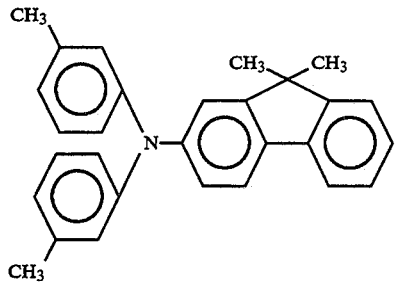
2-(28)
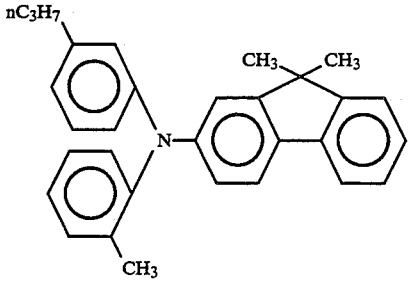
2-(29)
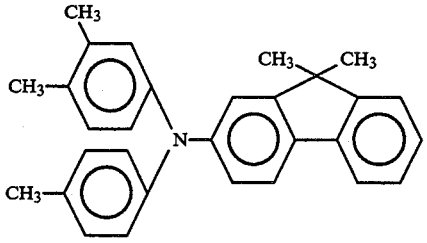
2-(30)
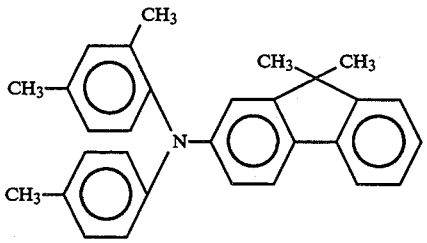
2-(31)
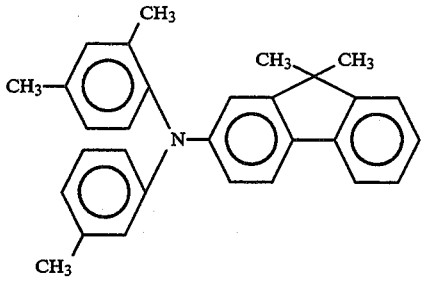
2-(32)
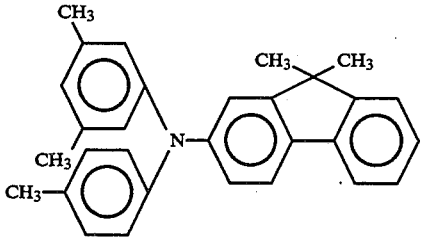
-continued
2-(33)
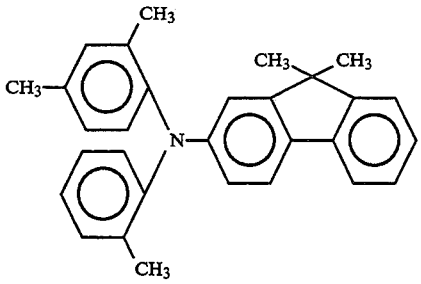
2-(34)
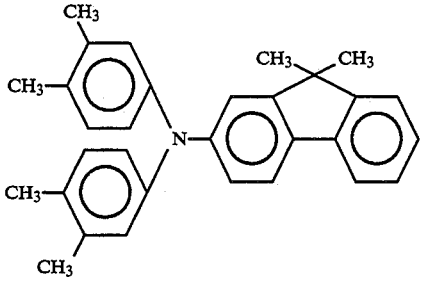
2-(35)
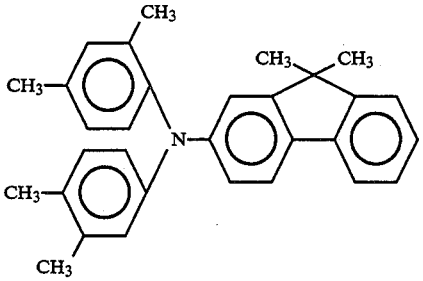
2-(36)
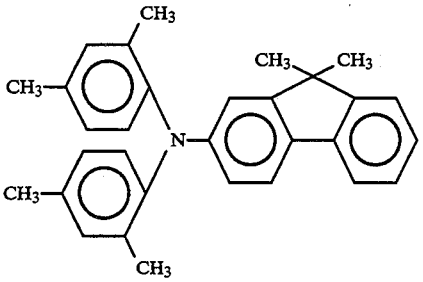
2-(37)
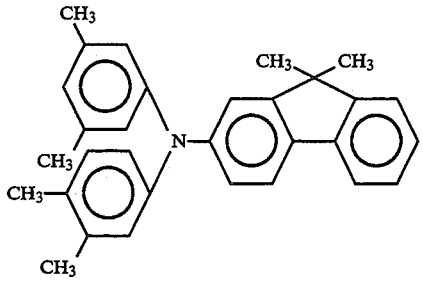
2-(38)
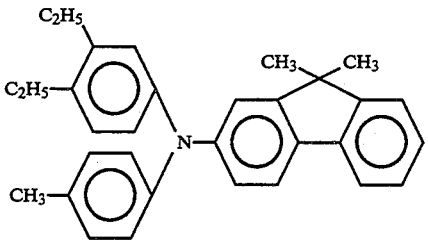

-continued
2-(39)
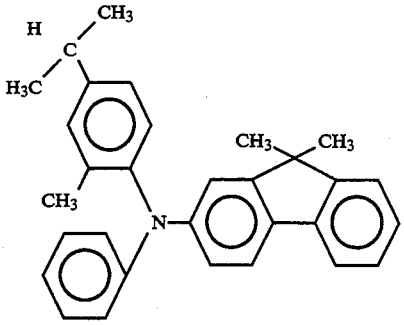
2-(40)
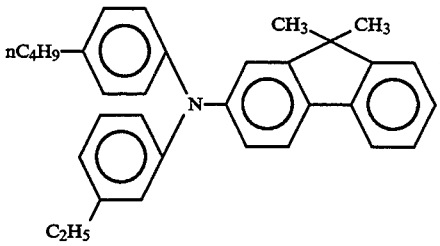
2-(41)
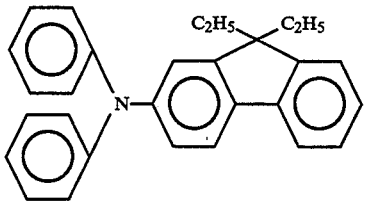
2-(42)
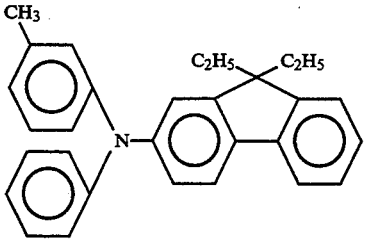
2-(43)
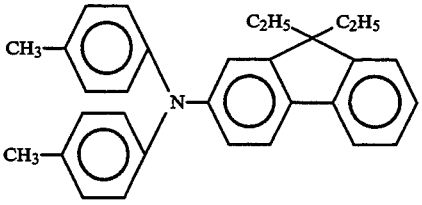
2-(44)
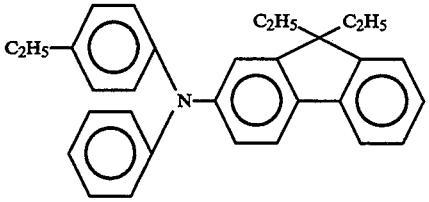
-continued
2-(45)
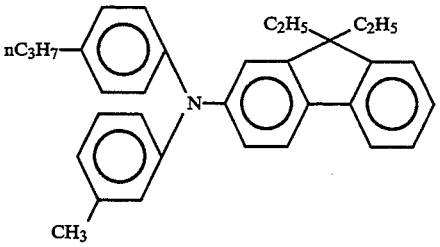
2-(46)
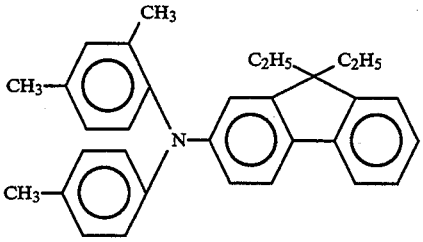
2-(47)
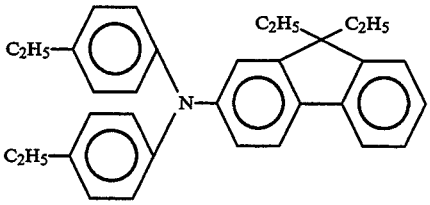
2-(48)
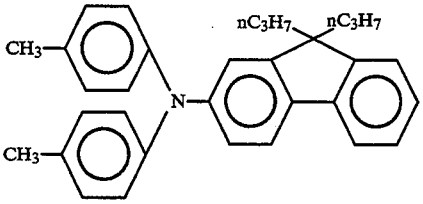
2-(49)
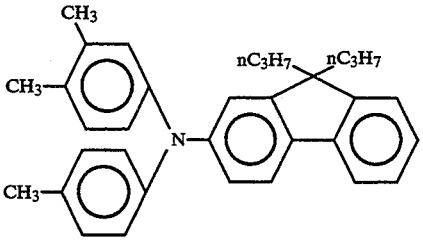
2-(50)
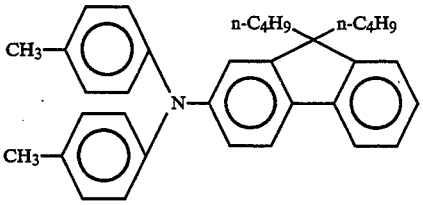
2-(51)
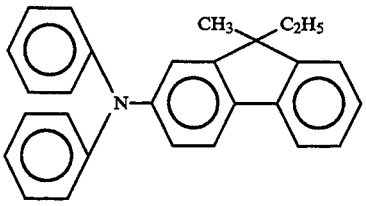

-continued 2-(52)

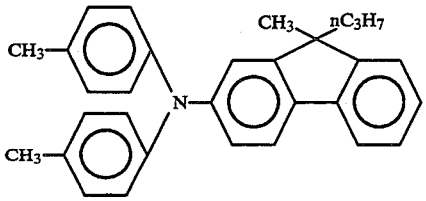

2-(53)

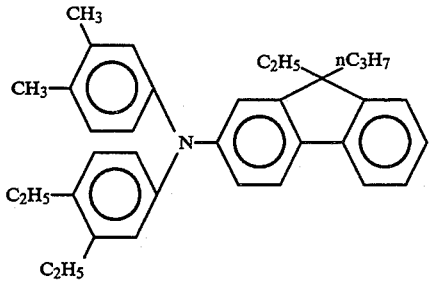

-continued 2-(54)

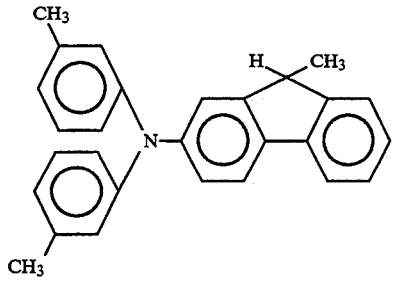

SYNTHESIS EXAMPLE

Synthesis of Example Compound No. 1-4

16.9 g of diphenylamine, 50.0 g of 9,9-dimethylfluorene, 10.0 g of potassium carbonate anhydride and 3.0 g of copper powder were added to 70 ml of o-dichlorobenze, followed by stirring for 8 hours at 180°–185° C. After the reaction, the reaction mixture was cooled and subjected to filtration. The filtrate was concentrated under reduced pressure to obtain a solid. An appropriate amount of methylethylketone was added to the solid to obtain a crystal. The crystal was recovered by filtration and purified by silica gel column chromatography (eluent: toluene/hexane) to obtain 28.2 g of 2-(N,N-diphenyl)amino-9,9-dimethylfluorenone (Yield: 79%; melting point: 144.2°–145.1° C.).

Hereinbelow, specific and non-exhaustive examples of the above-mentioned triarylamine compounds represented by the formula (3) may include those shown by the following structural formulas.

| No. | Structural formula | m.p. (°C.) |
|---|---|---|
| | m.p. ≦160° C. | |
| 3-1 | 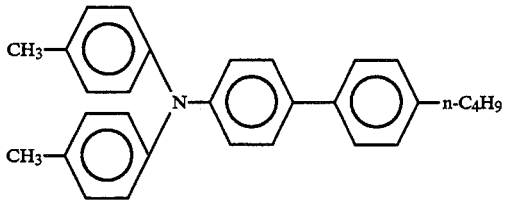 | Oily (at room temp.) |
| 3-2 | 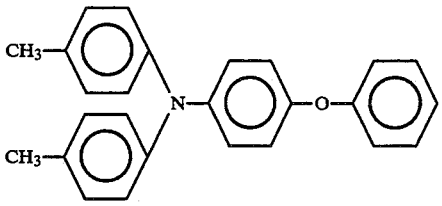 | Oily (at room temp.) |
| 3-3 | 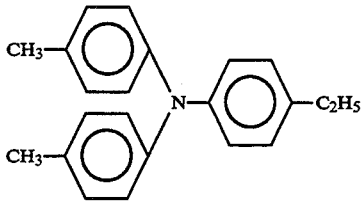 | 62.5~65.5 |

-continued
| No. | Structural formula | m.p. (°C.) |
|---|---|---|
| 3-4 | 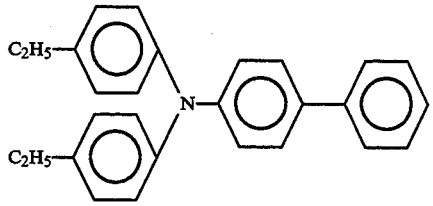 | 69~71 |
| 3-5 | 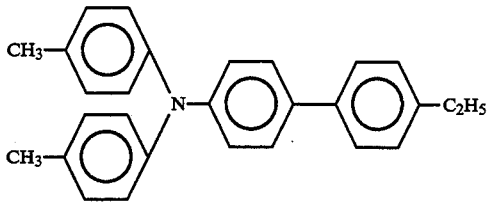 | 80.5~81.5 |
| 3-6 | 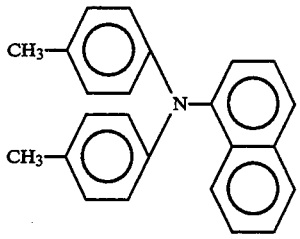 | 82~84 |
| 3-7 | 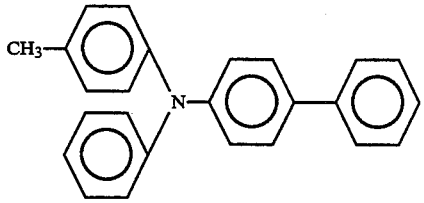 | 92~94 |
| 3-8 | 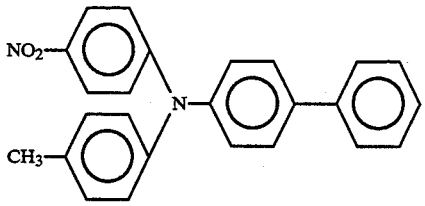 | 95~97 |
| 3-9 | 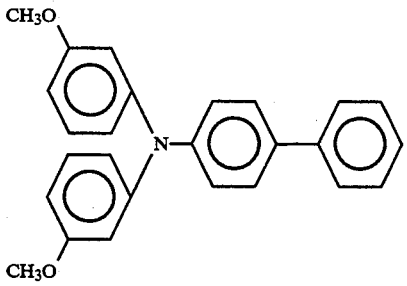 | 96~97 |

-continued
| No. | Structural formula | m.p. (°C.) |
|---|---|---|
| 3-10 | 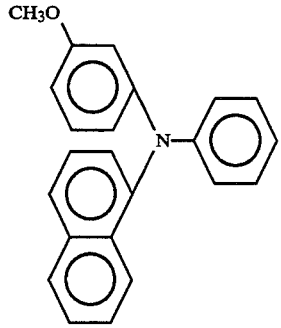 | 96~98 |
| 3-11 | 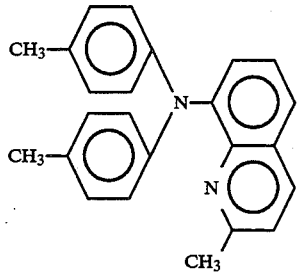 | 99~100 |
| 3-12 | 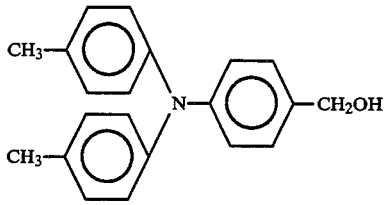 | 100~101 |
| 3-13 | 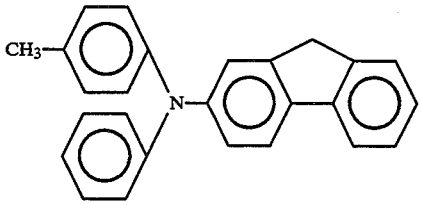 | 99.5~101.5 |
| 3-14 | 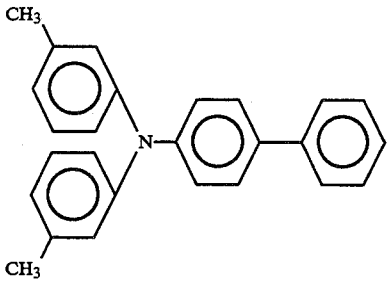 | 103~104 |
| 3-15 | 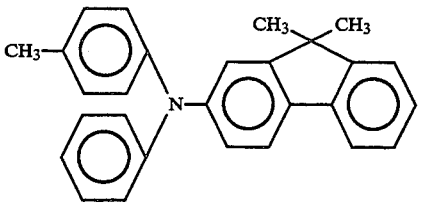 | 103~104 |

-continued
| No. | Structural formula | m.p. (°C.) |
|---|---|---|
| 3-16 | 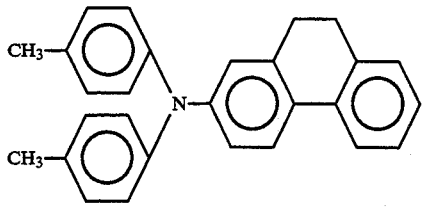 | 104~106 |
| 3-17 | 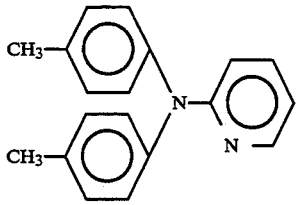 | 105~106.5 |
| 3-18 | 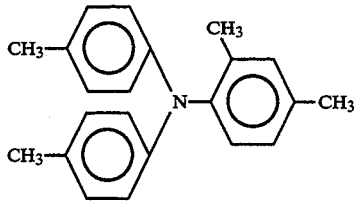 | 105.5~107 |
| 3-19 | 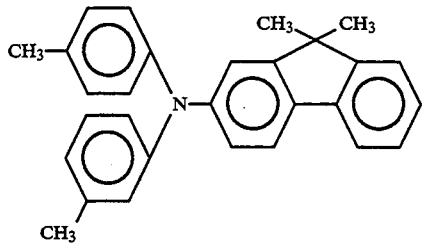 | 107~108 |
| 3-20 | 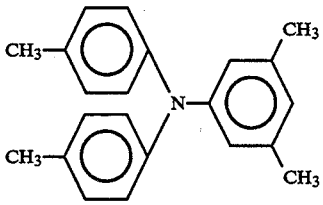 | 108~109 |
| 3-21 | 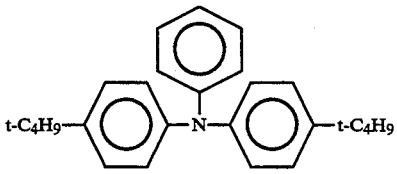 | 111~112 |
| 3-22 | 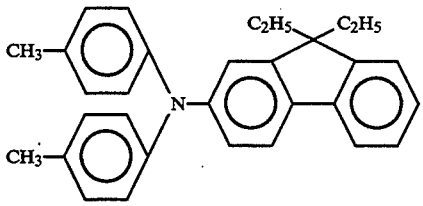 | 114~114.5 |

-continued
| No. | Structural formula | m.p. (°C.) |
|---|---|---|
| 3-23 | 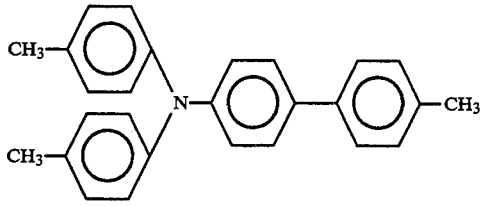 | 116~117 |
| 3-24 | 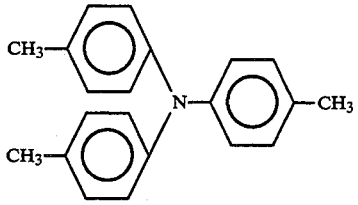 | 116~117 |
| 3-25 | 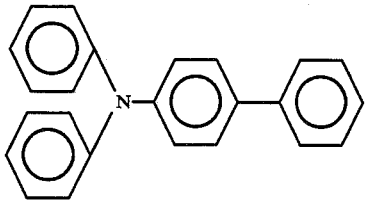 | 116.5~117.5 |
| 3-26 | 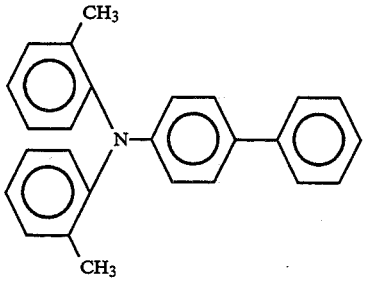 | 118.5~119.5 |
| 3-27 | 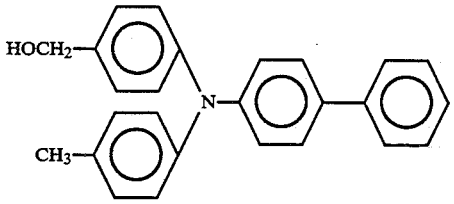 | 120~122 |
| 3-28 | 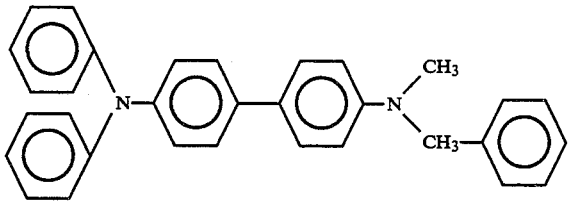 | 120.5~121.5 |
| 3-29 | 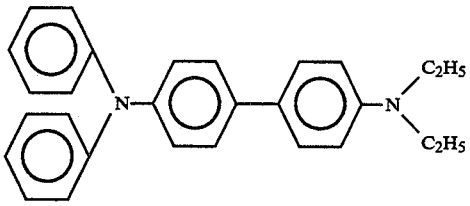 | 121~122 |

-continued
| No. | Structural formula | m.p. (°C.) |
|---|---|---|
| 3-30 | 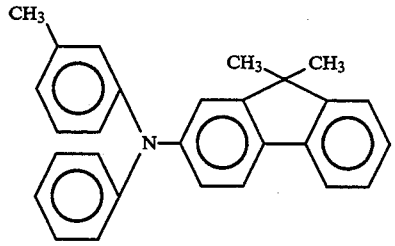 | 123~124 |
| 3-31 | 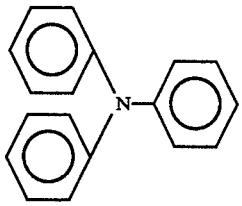 | 125~127 |
| 3-32 | 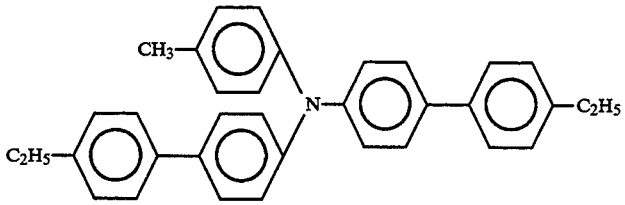 | 125.5~126.5 |
| 3-33 | 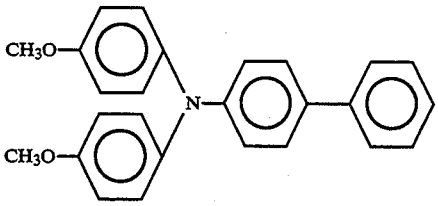 | 127.5~128.5 |
| 3-34 | 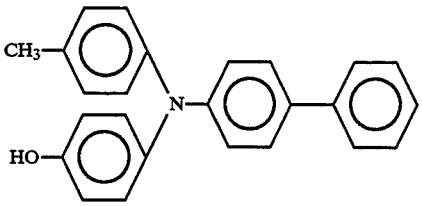 | 128~129.5 |
| 3-35 | 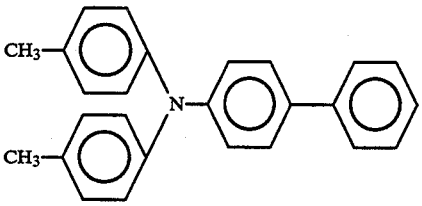 | 128.5~129.5 |
| 3-36 | 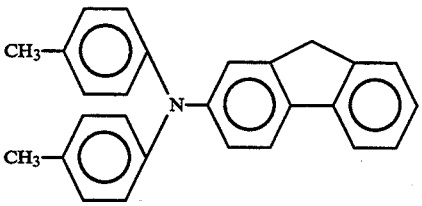 | 128~129 |

-continued
| No. | Structural formula | m.p. (°C.) |
|---|---|---|
| 3-37 | 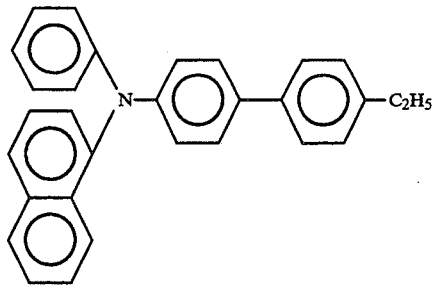 | 128~130 |
| 3-38 | 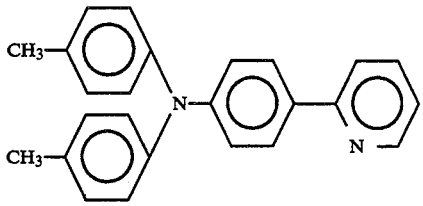 | 129~130 |
| 3-39 | 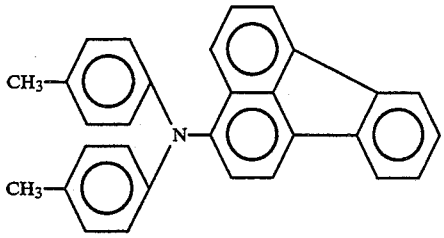 | 129~131 |
| 3-40 | 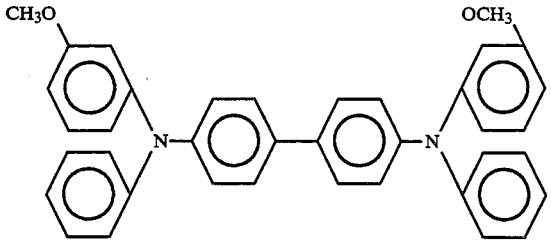 | 129~131 |
| 3-41 | 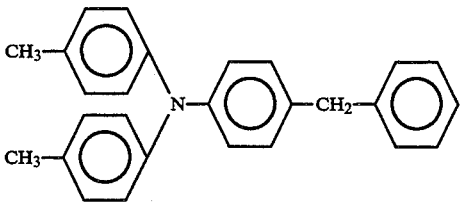 | 132~134 |
| 3-42 | 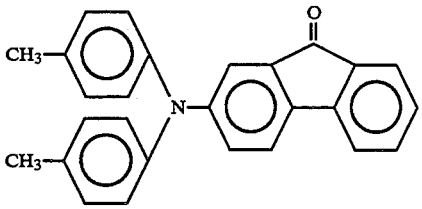 | 133.5~135.0 |

-continued
| No. | Structural formula | m.p. (°C.) |
|---|---|---|
| 3-43 | 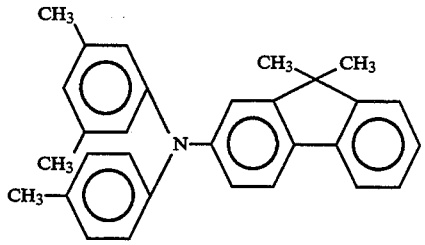 | 137~138 |
| 3-44 | 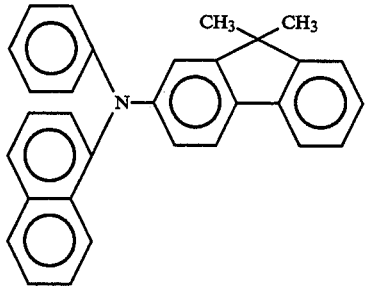 | 140~141 |
| 3-45 | 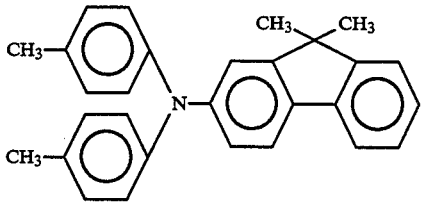 | 141.0~142.0 |
| 3-46 | 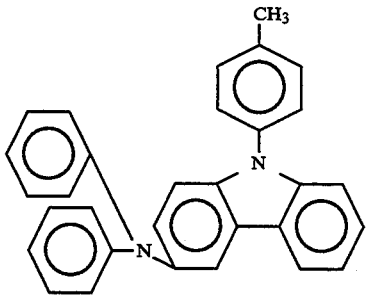 | 141.0~143.0 |
| 3-47 | 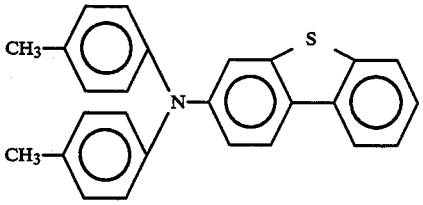 | 142~144 |
| 3-48 | 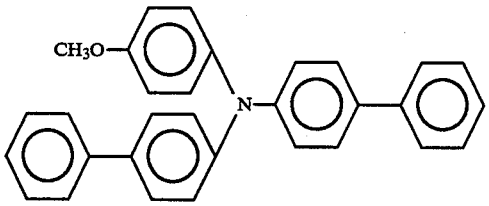 | 142.5~144.5 |

-continued
| No. | Structural formula | m.p. (°C.) |
|---|---|---|
| 3-49 | 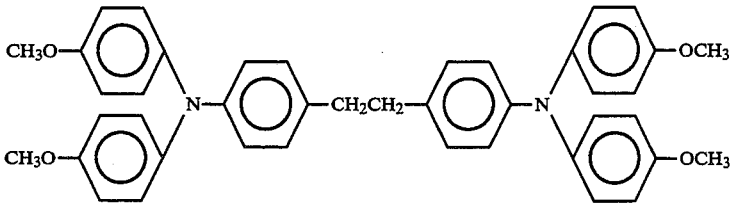 | 144.5～145.5 |
| 3-50 | 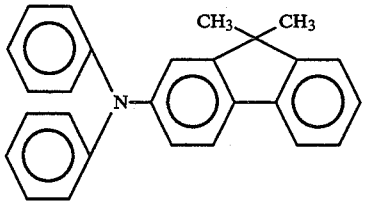 | 144.5～145.5 |
| 3-51 | 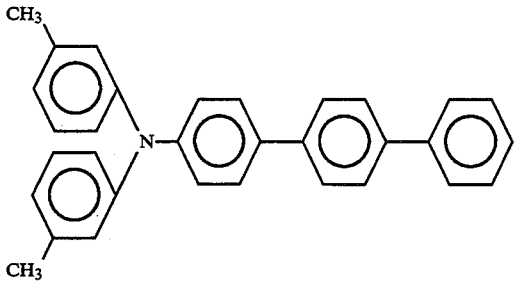 | 146.0～147.0 |
| 3-52 | 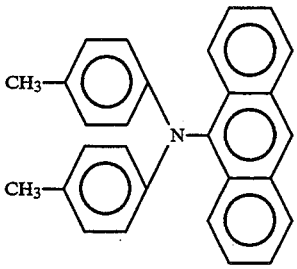 | 146.5～148.0 |
| 3-53 | 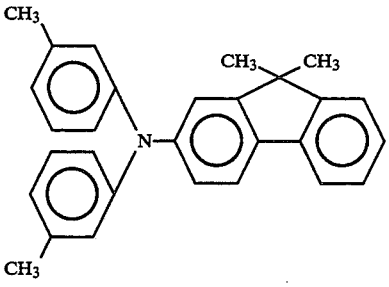 | 149～150 |
| 3-54 | 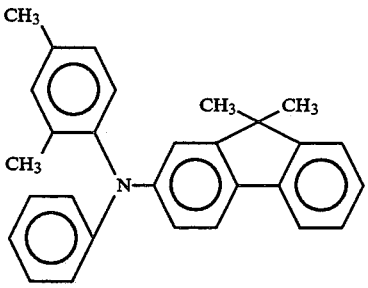 | 152～153 |

-continued
| No. | Structural formula | m.p. (°C.) |
|---|---|---|
| 3-55 | 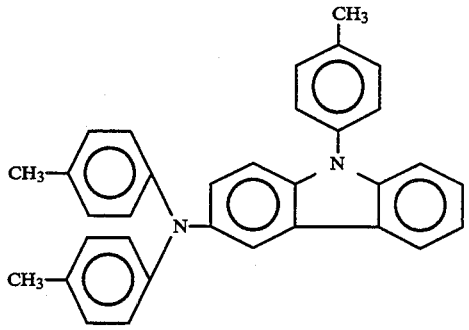 | 151~153 |
| 3-56 | 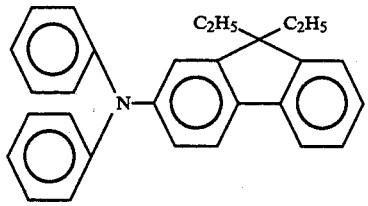 | 152.5~153.5 |
| 3-57 | 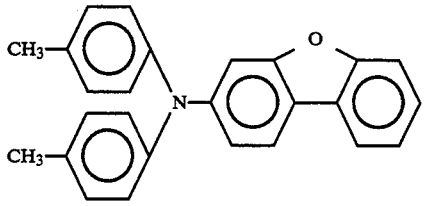 | 153.5~155.0 |
| 3-58 | 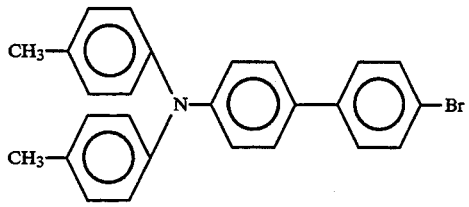 | 156.0~157.5 |
| | m.p. >160° C. (excluded from the formula (3) compound) | |
| 3-59 | 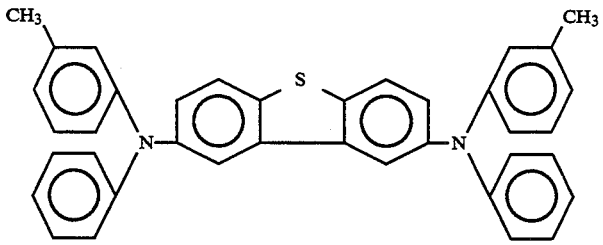 | 161.0~162.0 |
| 3-60 | 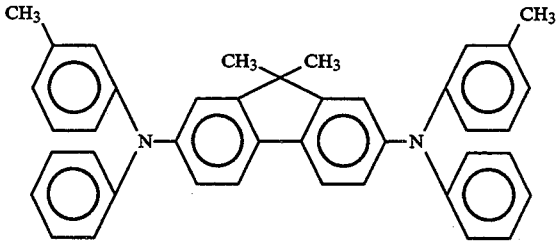 | 163.5~165.0 |

-continued
| No. | Structural formula | m.p. (°C.) |
|---|---|---|
| 3-61 | 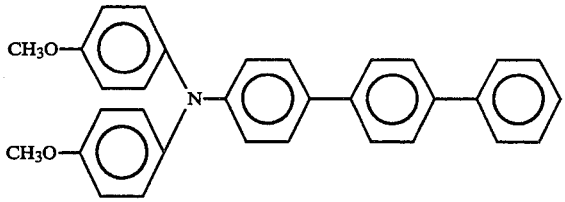 | 164.0~165.0 |
| 3-62 | 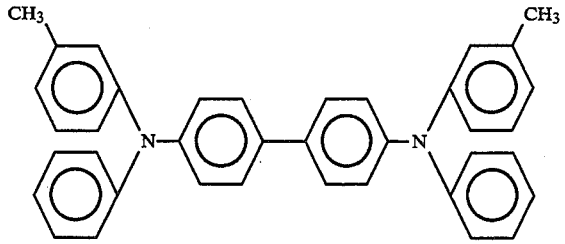 | 168.0~169.0 |
| 3-63 | 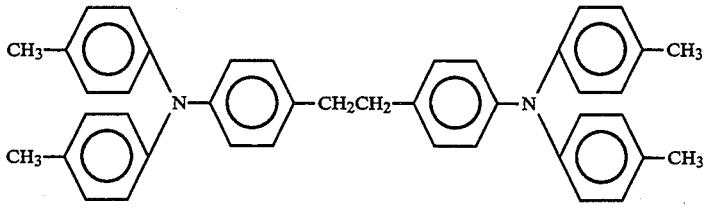 | 172.0~174.0 |
| 3-64 | 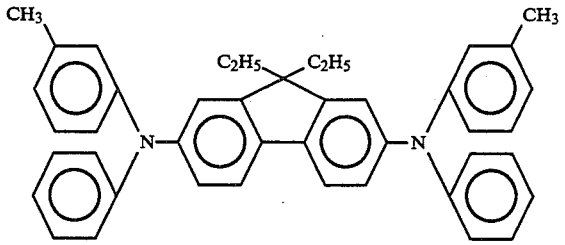 | 175.0~176.0 |
| 3-65 | 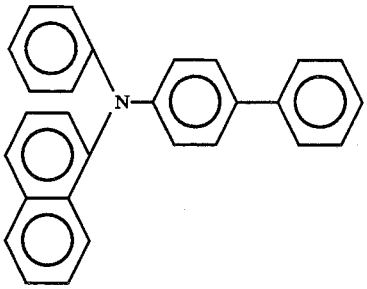 | 176.5~177.5 |
| 3-66 | 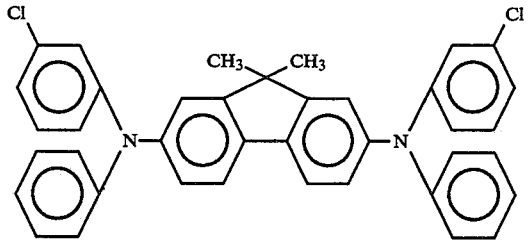 | 177.0~178.5 |

-continued
| No. | Structural formula | m.p. (°C.) |
|---|---|---|
| 3-67 | 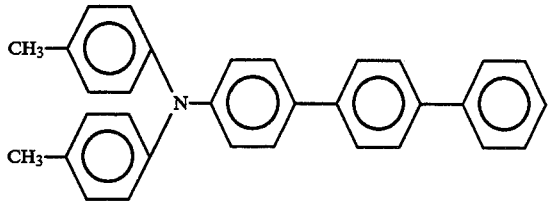 | 180.0~181.0 |
| 3-68 | 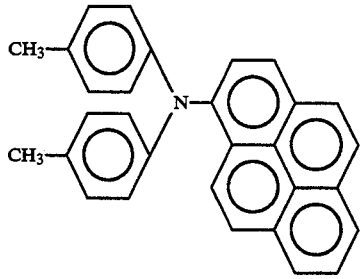 | 181.0~182.0 |
| 3-69 | 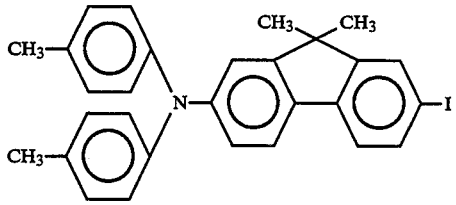 | 182.5~183.5 |
| 3-70 | 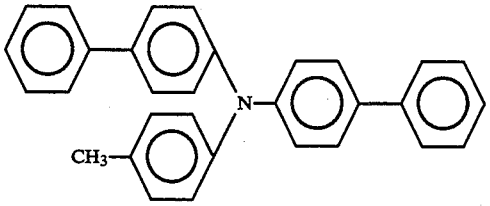 | 187.0~188.0 |
| 3-71 | 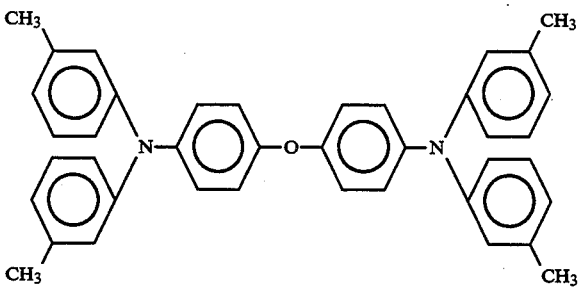 | 187.5~189.0 |
| 3-72 | 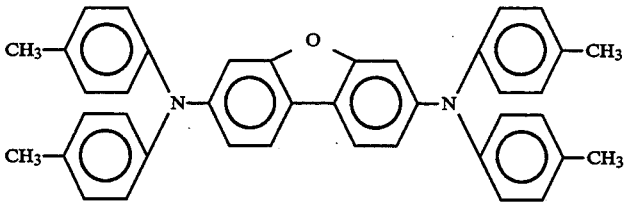 | 190.0~191.0 |

-continued
| No. | Structural formula | m.p. (°C.) |
|---|---|---|
| 3-73 | 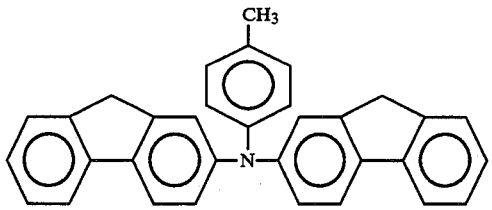 | 191.0~192.0 |
| 3-74 | 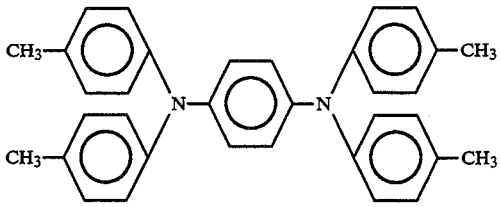 | 193.3~195.0 |
| 3-75 | 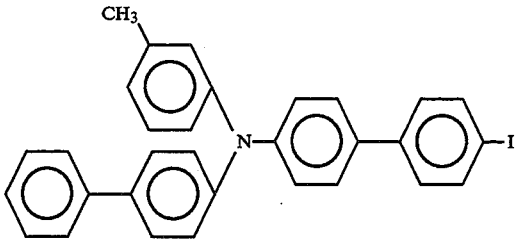 | 194.0~196.0 |
| 3-76 | 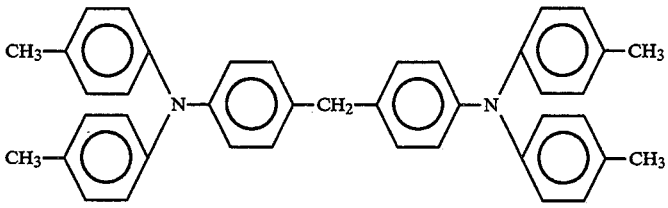 | 194.5~196.0 |
| 3-77 | 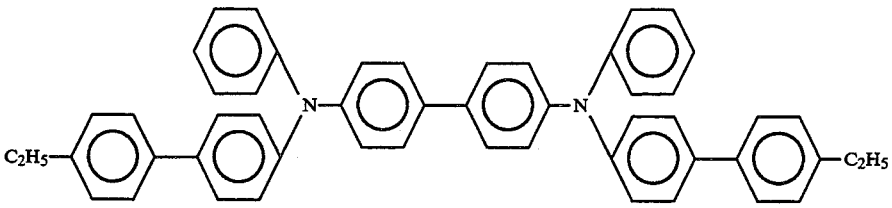 | 202.5~203.5 |
| 3-78 | 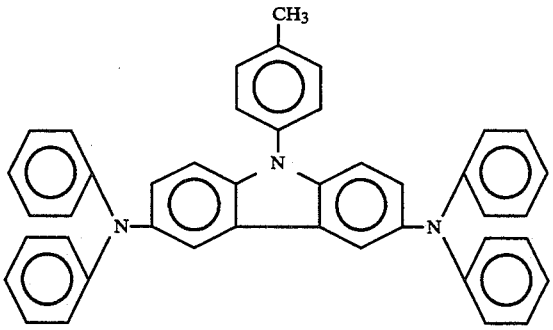 | 211.0~212.5 |

-continued

| No. | Structural formula | m.p. (°C.) |
|---|---|---|
| 3-79 | 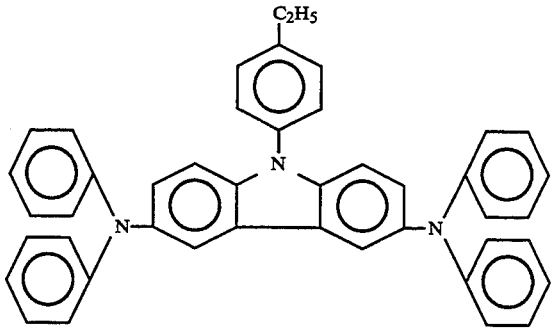 | 219.0~220.0 |
| 3-80 | 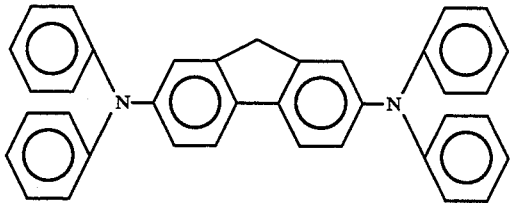 | 240.0~241.0 |
| 3-81 | 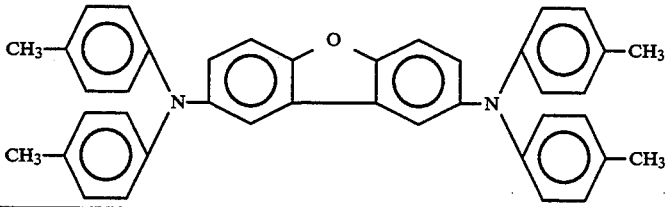 | 243.0~244.5 |

The photosensitive layer of the electrophotographic photosensitive member of the present invention may, e.g., include the following layer structure:

(1) A lower layer containing a charge-generating material and an upper layer containing a charge-transporting material;

(2) A lower layer containing a charge-transporting material and a upper layer containing a charge-generating material; and (3) A single layer containing a charge-generating material and a charge-transporting material.

The fluorene compounds of the formulae (1) and (2) and the triphenylamine compound of the formula (3) having a melting point of at most 160° C. each have a high hole-transporting ability and accordingly may preferably be used as a charge-transporting material contained in the above photosensitive layer having the structure of (1), (2) or (3). A polarity of a primary charge for use in a charging step of the photosensitive member of the present invention may preferably be negative for the structure (1), positive for the structure (2) and negative or positive for the structure (3).

In the present invention, the photosensitive member may comprise a protective layer disposed on the surface of a photosensitive layer for improving a durability or adhesive properties. It is also possible to dispose a undercoating layer (or a primary layer) between a photosensitive layer and an electroconductive support for controlling charge injection properties.

The photosensitive member of the present invention may preferably contain a photosensitive layer having the above-mentioned layer structure (1). Hereinbelow, the photosensitive member containing such a photosensitive layer will be explained by way of preferred embodiment.

The photosensitive member comprises an electroconductive support, a charge generation layer (CGL) containing a charge-generating material (CGM), a charge transport layer (CTL) containing a charge-transporting material (CTM) in this order and optionally comprises the above-mentioned undercoating layer and/or protective layer. The CGL and the CTL constitute a photosensitive layer as a whole.

The electroconductive support may include:

(i) A metal or an alloy such as aluminum, aluminum alloy, stainless steel or copper in the form of a plate or a drum (or a cylinder);

(ii) A laminated or vapor-deposited support comprising a non-electroconductive substance such as glass, a resin or paper, or the above support (i) each having thereon a layer of a metal or an alloy such as aluminum, aluminum alloy, palladium, rhodium, gold or platinum; and (iii) A coated or vapor-deposited support comprising a non-electroconductive substance such as glass, a resin or paper, or the above support (i) each having thereon a layer of an electroconductive substance such as an electroconductive polymer, tin oxide or indium oxide.

The CGM contained in the CGL may include:

(i) Azo pigments of monoazo-type, bisazo-type, trisazo-type, etc.;

(ii) Phthalocyanine pigments such as metallophthalocyanine and non-metallophthalocyanine;

(iiI) Indigo pigments such as indigo and thioindigo;

(iv) Perylene pigments such as perylenic anhydride and perylenimide;
(v) Polycyclic quinones such as anthraquinone and pyrene-1,8-quinone;
(vi) Squarium colorant;
(vii) Pyrylium salts and thiopyrylium salts;
(viii) Triphenylmethane-type colorants; and
(ix) Inorganic substances such as selenium and amorphous silicon.

The above CGM may be used singly or in combination of two or more species.

In the present invention, azo pigments (i) and phthalocyanine pigments (ii) may preferably be used as the CGM. Particularly, a phthalocyanine pigment of the formula (A) below and azo pigments of the formulae (B-1), (B-2), (B-3) and (C) below may suitably be used.

(A)

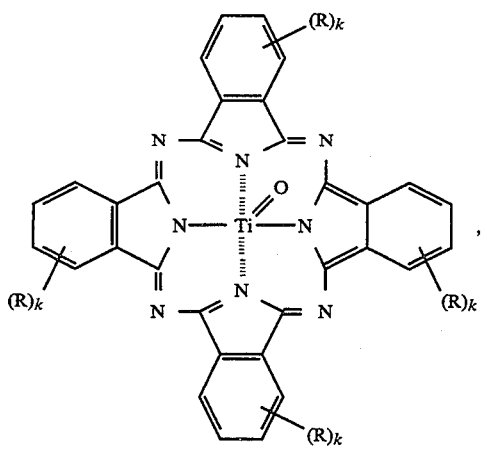

Wherein R denotes hydrogen atom, halogen atom, alkyl group, alkoxy group, cyano group or nitro group and k is an integer of 1–4.

(B-1)

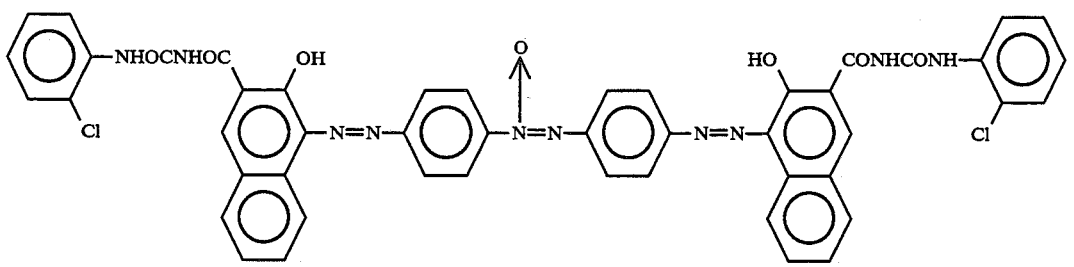

(B-2)

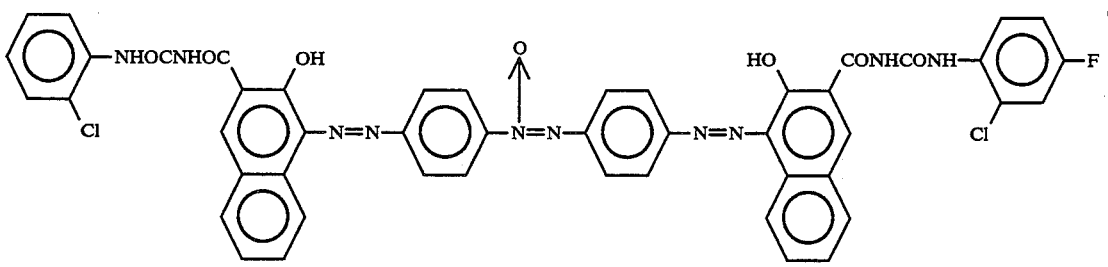

(B-3)

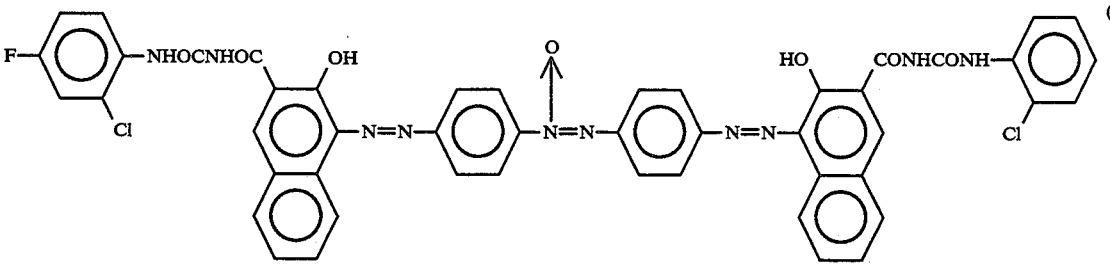

-continued (C)

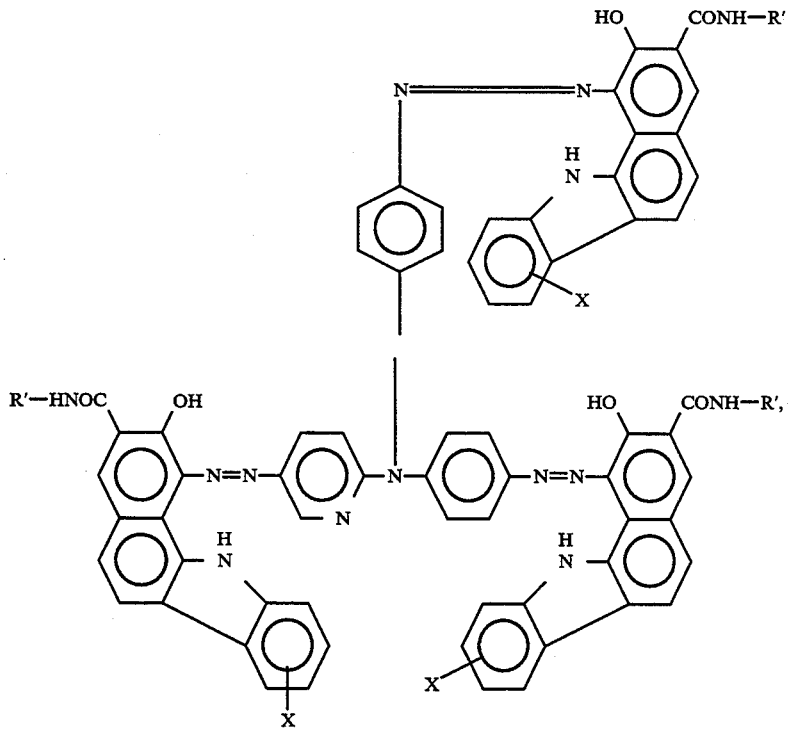

wherein R′ denotes alkyl group, aralkyl group, aryl group or heterocyclic group; and X denotes hydrogen atom, halogen atom, alkoxy group, cyano group or nitro group.

In the above formulae (A) and (C), R and R′ may include the following specific groups: halogen atom such as fluorine, chlorine or bromine; alkyl group such as methyl, ethyl or propyl; alkoxy group such as methoxy, ethoxy or propoxy; aryl group such as phenyl, naphthyl or anthryl; aralkyl group such as benzyl or phenethyl; and heterocyclic group such as pyridyl, thienyl, furyl or quinolyl.

R or R′ of the pigments (A) and (B) may each have a substituent. Examples of the substituent may include: alkyl group such as methyl, ethyl, propyl or butyl; aralkyl group such as benzyl, phenethyl or naphthylmethyl; aryl group such as phenyl, naphthyl, anthryl or pyrenyl; heterocyclic group such as pyridyl, thienyl, quinolyl or furyl; alkoxy group such as methoxy, ethoxy or propoxy; aryloxy group such as phenoxy or naphthoxy; halogen atom such as fluorine, chlorine, bromine or iodine; alkylthio group such as methylthio or ethylthio; arylthio group such as phenylthio or naphthylthio; amino group such as dimethylamino, diethylamino or diphenylamino; and hydroxyl group.

Then, the pigments (A) and (C) may preferably contain the following particular groups enumerated below.

| Ex. Pigment No. | R | k |
|---|---|---|
| | Phthalocyanine pigment (A) | |
| A-(1) | —H | 1 |
| A-(2) | —$CH_3$ | 1 |
| A-(3) | —Cl | 1 |
| A-(4) | —Cl | 4 |
| A-(5) | —Br | 1 |
| A-(6) | —$OCH_3$ | 1 |
| A-(7) | —CN | 1 |
| A-(8) | —$NO_2$ | 1 |

-continued

| Ex. Pigment No. | R′ | X |
|---|---|---|
| | Azo pigment (C) | |
| C-(1) | 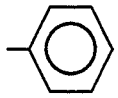 | H |
| C-(2) | $CH_3$ 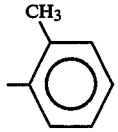 | H |
| C-(3) | $C_2H_5$ 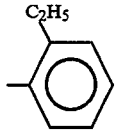 | H |
| C-(4) | $C_3H_7$ 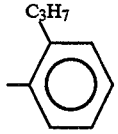 | H |
| C-(5) | Cl 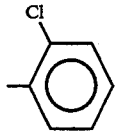 | H |
| C-(6) | $CH_3$ 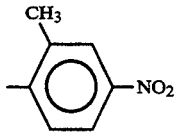 $NO_2$ | H |

-continued

| | | |
|---|---|---|
| C-(7) | 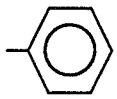 | Cl |
| C-(8) | 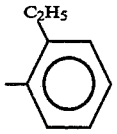 | Cl |
| C-(9) | 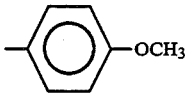 | Cl |
| C-(10) | 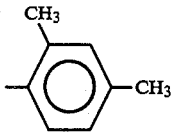 | Cl |
| C-(11) | 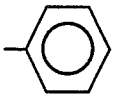 | Br |
| C-(12) | 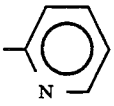 | Br |
| C-(13) | 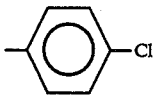 | F |
| C-(14) | 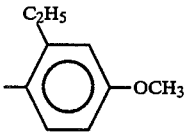 | F |
| C-(15) | 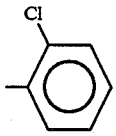 | $OCH_3$ |
| C-(16) | 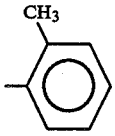 | CN |
| C-(17) | 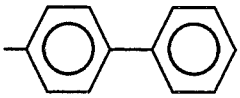 | CN |
| C-(18) | 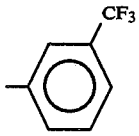 | $NO_2$ |

-continued

| | | |
|---|---|---|
| C-(19) | 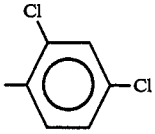 | $NO_2$ |
| C-(20) | 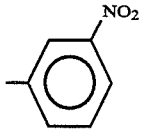 | $NO_2$ |

In the present invention, the CGL may be formed on the electroconductive support by vapor-deposition, sputtering or chemical vapor deposition (CVD), or by dispersing the CGM in an appropriate solution containing a binder resin and applying the resultant coating liquid onto the electroconductive support by means of a known coating method such as dipping, spinner coating, roller coating, wire bar coating, spray coating or blade coating and then drying the coating. Examples of the binder resin used may be selected from various known resins such as a polycarbonate resin, a polyester resin, a polyarylate resin, a polyvinyl butyral resin, a polystyrene resin, a polyvinyl acetal resin, a diallylphthalate resin, an acrylic resin, a methacrylic resin, a vinyl acetate resin, a phenoxy resin, a silicone resin, a polysulfone resin, a styrene-butadiene copolymer, an alkyd resin, an epoxy resin, urea resin and a vinyl chloride-vinyl acetate copolymer. These binder resins may be used singly or in combination of two or more species. The CGL may preferably contain at most 80 wt. %, particularly at most 40 wt. %, of the binder resin.

Examples of the solvent used may be selected from those dissolving the above-mentioned binder resin and may preferably include: ethers, ketones, amines, esters, aromatic compounds, alcohols, and aliphatic halogenated hydrocarbons. The CGL may contain one or more known sensitizing agent, as desired.

The CGL may preferably have a thickness of at most 5 $\mu$m, particularly 0.01 to 2 $\mu$m.

The CTL according to the present invention may preferably be formed by dissolving the above-mentioned fluorene compound or triarylamine compound satisfying the condition (a) or (b) in an appropriate solvent together with a binder resin, applying the resultant coating liquid such as solution onto a predetermined surface (e.g., the surface of an electroconductive substrate, charge generation layer, etc.) by the above-mentioned coating method, and then drying the resultant coating.

Examples of the binder resin to be used for forming the CTL may include: the resins used for the CGL described above; and organic photoconductive polymers such as poly-N-vinylcarbazole and polyvinylanthracene.

The CTM (i.e., the fluorene compound (1) or the fluorene compound (2) and the triarylamine compound (3)) may preferably be mixed with the binder resin in a proportion of 10 to 500 wt. parts, particularly 50 to 200 wt. parts, to 100 wt. parts of the binder resin. A mixing ratio of the compound (2)/the compound (3) may preferably be 1/9 to 9/1 by weight.

The CTL and the CGL are electrically connected each other. Accordingly, the CTM contained in the CTL has functions of receiving charge carriers generated in the CGL and transporting the charge carries from the CGL or CTL to the surface of the photosensitive layer under electric field application.

The CTL may preferably have a thickness of 5 to 40 μm, particularly 10 to 30 μm, in view of a charge-transporting ability of the CTM since the CTM fails to transport the charge carries when a thickness of the CTL is too large. The CTL may contain further additives such as an antioxidant, an ultraviolet absorbing agent, and a plasticizer, as desired.

In a case where a photosensitive layer has a single layer structure (i.e., the above-mentioned structure (3)), the photosensitive layer may preferably have a thickness of 5 to 40 μm, particularly 10 to 30 μm.

The electrophotographic photosensitive member according to the present invention can be applied to not only an ordinary electrophotographic copying machine but also a facsimile machine, a laser beam printer, a light-emitting diode (LED) printer, a cathode-ray tube (CRT) printer, a liquid crystal printer, and other fields of applied electrophotography including, e.g., laser plate making.

FIG. 1 shows a schematic structural view of an electrophotographic apparatus using an electrophotographic photosensitive member of the invention. Referring to FIG. 1, a photosensitive drum (i.e., photosensitive member) 1 as an image-carrying member is rotated about an axis 1*a* at a prescribed peripheral speed in the direction of the arrow shown inside of the photosensitive drum 1. The surface of the photosensitive drum is uniformly charged by means of a charger 2 to have a prescribed positive or negative potential. At an exposure part 3, the photosensitive drum 1 is exposed to light-image L (as by slit exposure or laser beam-scanning exposure) by using an image exposure means (not shown), whereby an electrostatic latent image corresponding to an exposure image is successively formed on the surface of the photosensitive drum 1. The electrostatic latent image is developed by a developing means 4 to form a toner image. The toner image is successively transferred to a transfer material P which is supplied from a supply part (not shown) to a position between the photosensitive drum and a transfer charger 5 in synchronism with the rotating speed of the photosensitive drum 1, by means of the transfer charger 5. The transfer material P with the toner image thereon is separated from the photosensitive drum to be conveyed to a fixing device 8, followed by image fixing to print out the transfer material P as a copy outside the electrophotographic apparatus. Residual toner particles on the surface of the photosensitive drum after the transfer are removed by means of a cleaner 6 to provide a cleaned surface, and residual charge on the surface of the photosensitive drum is erased by a pre-exposure means 7 to prepare for the next cycle. As the charger 2 for charging the photosensitive drum uniformly, a corona charger is widely used in general. As the transfer charger 5, such a corona charger is also widely used in general.

According to the present invention, in the electrophotographic apparatus, it is possible to provide a device unit which includes plural means inclusive of or selected from the photosensitive member (photosensitive drum), the charger, the developing means, the cleaner, etc. so as to be attached or removed as desired. The device unit may, for example, be composed of the photosensitive member and at least one device of the charger, the developing means and the cleaner to prepare a single unit capable of being attached to or removed from the body of the electrophotographic apparatus by using a guiding means such as a rail in the body.

In case where the electrophotographic apparatus is used as a copying machine or a printer, exposure light-image L may be given by reading a data on reflection light or transmitted light from an original or reading on the original by means of a sensor, converting the data into a signal and then effecting a laser beam scanning, a drive of LED array or a drive of a liquid crystal shutter array so as to expose the photosensitive member with the light-image L.

Figure 2:
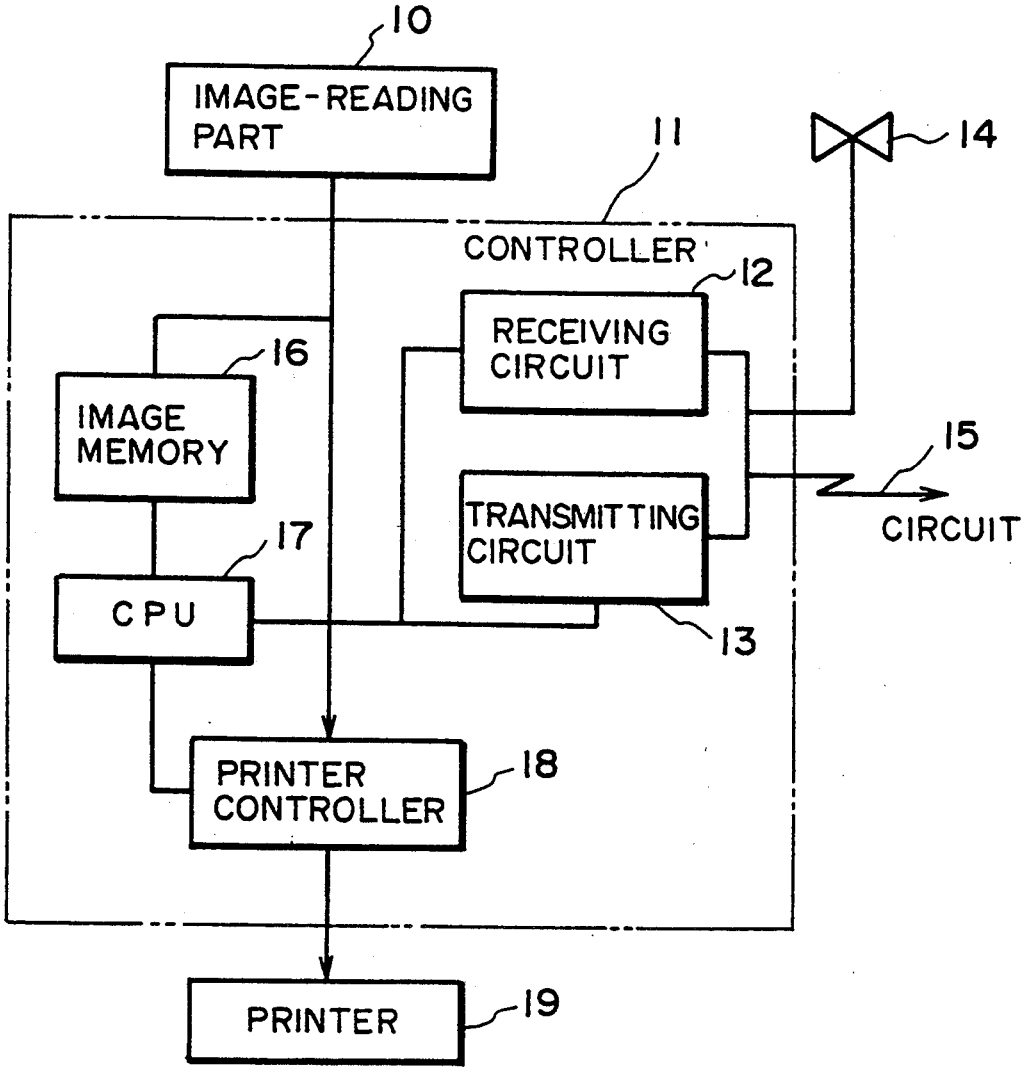
FIG. 2 is a block diagram of a facsimile machine using an electrophotographic apparatus according to the present invention as a printer.

In case where the electrophotographic apparatus according to the present invention is used as a printer of a facsimile machine, exposure light-image L is given by exposure for printing received data. FIG. 2 shows a block diagram of an embodiment for explaining this case. Referring to FIG. 2, a controller 11 controls an image-reading part 10 and a printer 19. The whole controller 11 is controlled by a CPU (central processing unit) 17. Read data from the image-reading part is transmitted to a partner station through a transmitting circuit 13, and on the other hand, the received data from the partner station is sent to the printer 19 through a receiving circuit 12. An image memory memorizes prescribed image data. A printer controller 18 controls the printer 19, and a reference numeral 14 denotes a telephone handset.

The image received through a circuit 15 (the image data sent through the circuit from a connected remote terminal) is demodulated by means of the receiving circuit 12 and successively stored in an image memory 16 after a restoring-signal processing of the image data. When image for at least one page is stored in the image memory 16, image recording of the page is effected. The CPU 17 reads out the image data for one page from the image memory 16 and sends the image data for one page subjected to the restoring-signal processing to the printer controller 18. The printer controller 18 receives the image data for one page from the CPU 17 and controls the printer 19 in order to effect image-data recording. Further, the CPU 17 is caused to receive image for a subsequent page during the recording by the printer 19. As described above, the receiving and recording of the image are performed.

Hereinbelow, the present invention, will be explained more specifically with reference to examples.

EXAMPLE 1-1

A coating liquid for a charge generation layer (CGL) was prepared by adding 1.0 g of a bisazo pigment of the formula:

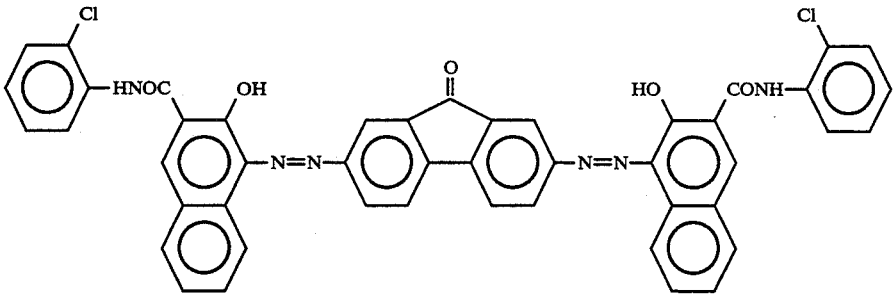

to a solution of 0.4 g of a butyral resin (butyral degree of 80 mol. %) in 60 ml of cyclohexanone and dispersing for 10 hours by means of a sand mill.

The coating liquid for the CGL was applied onto an aluminum sheet by a wire bar and dried to obtain a 0.15 μm-thick CGL.

Then, 1.0 g of a fluorene compound (Ex. Comp. No. 1-4) and 1.0 g of a polycarbonate resin (weight-average molecular weight (Mw=20,000) were dissolved in 7.0 g of mono-chlorobenzene to prepare a coating liquid.

The coating liquid was applied onto the above-prepared CGL by means of a wire bar, followed by drying to form a charge transport layer (CTL) having a thickness of 23 microns, whereby an electrophotographic photosensitive member was prepared.

The thus prepared photosensitive member was negatively charged by using corona (−5 KV) according to a static method by means of an electrostatic copying paper tester (Model: SP-428, mfd. by Kawaguchi Denki K.K.) and retained in a dark place for 1 sec. Thereafter, the photosensitive member was exposed to light at an illuminance of 20 lux to evaluate charging characteristics. More specifically, the charging characteristics were evaluated by measuring a surface potential ($V_0$) at an initial stage, a surface potential ($V_1$) obtained after a dark decay for 1 sec, and the exposure quantity ($E_{1/5}$: lux.sec) (i.e., sensitivity) required for decreasing the potential $V_1$ to 1/5 thereof.

In order to evaluate fluctuations of a light part potential ($V_L$) and a dark part potential ($V_D$), the above photosensitive member was attached to a cylinder for a photosensitive drum of a plane paper copying machine (PPC) NP-3825 (manufactured by Canon K.K.) and subjected to a copying test (or a durability test) of 5,000 sheets on condition that $V_D$ and $V_L$ at an initial stage were set to −700 V and −200 V, respectively. After the copying test of 5,000 sheets, $V_D$ and $V_L$ were measured to evaluate the fluctuations of $V_D$ and $V_L$, respectively, in comparison with those at the initial stage.

The results are shown in Table 1.

TABLE 1

| | $V_0$ | $V_1$ | $E_{1/5}$ (lux · | Initial $V_D$ | Initial $V_L$ | After 5,000 sheets $V_D$ | After 5,000 sheets $V_L$ |
|---|---|---|---|---|---|---|---|

TABLE 1-continued

| Ex. | (−V) | (−V) | sec) | (−V) | (−V) | (−V) | (−V) |
|---|---|---|---|---|---|---|---|
| 1-1 | 715 | 710 | 0.95 | 700 | 200 | 700 | 200 |

EXAMPLES 1-2 TO 1-8 AND COMPARATIVE EXAMPLES 1-1 TO 1-3

Electrophotographic photosensitive members were prepared and evaluated in the same manner as in Example 1-1 except that the fluorene compound (1-4) was changed to the above-mentioned fluorene compounds (1-1), (1-5), (1-6), (1-7), (1-9), (1-10) and (1-11) or the following comparative compounds (1-1C), (1-2C) and (1-3C), respectively.

Comp. Compound No.

(1-1C)

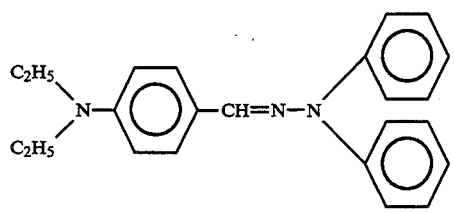

(1-2C)

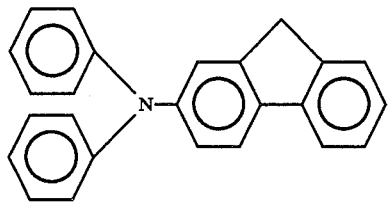

(1-3C)

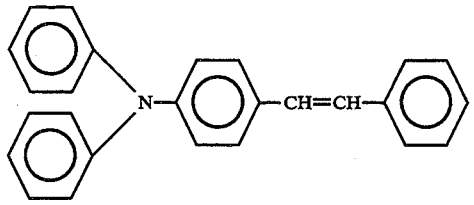

The results are shown in Tables 2 and 3.

TABLE 2

| Ex. | Ex. Comp. No. | $V_0$ (−V) | $V_1$ (−V) | $E_{1/5}$ (lux · sec) | Initial $V_D$(−V) | Initial $V_L$(−V) | After 5,000 sheets $V_D$(−V) | After 5,000 sheets $V_L$(−V) |
|---|---|---|---|---|---|---|---|---|
| 1-2 | 1-1 | 710 | 700 | 1.22 | 700 | 200 | 685 | 240 |
| 1-3 | 1-5 | 705 | 700 | 1.00 | 700 | 200 | 695 | 205 |
| 1-4 | 1-6 | 695 | 680 | 1.10 | 700 | 200 | 690 | 205 |
| 1-5 | 1-7 | 715 | 695 | 1.20 | 700 | 200 | 690 | 226 |
| 1-6 | 1-9 | 715 | 695 | 1.20 | 700 | 200 | 690 | 210 |
| 1-7 | 1-10 | 710 | 699 | 1.05 | 700 | 200 | 695 | 205 |

TABLE 2-continued

| Ex. | Ex. Comp. No. | $V_0$ (−V) | $V_1$ (−V) | $E_{1/5}$ (lux · sec) | Initial $V_D$(−V) | Initial $V_L$(−V) | After 5,000 sheets $V_D$(−V) | After 5,000 sheets $V_L$(−V) |
|---|---|---|---|---|---|---|---|---|
| 1-8 | 1-11 | 705 | 697 | 1.11 | 700 | 200 | 696 | 205 |

TABLE 3

| Comp. Ex. | Comp. Comp. No. | $V_0$ (−V) | $V_1$ (−V) | $E_{1/5}$ (lux · sec) | Initial $V_D$(−V) | Initial $V_L$(−V) | After 5,000 sheets $V_D$(−V) | After 5,000 sheets $V_L$(−V) |
|---|---|---|---|---|---|---|---|---|
| 1-1 | 1-1C | 705 | 670 | 2.3 | 700 | 200 | 610 | 320 |
| 1-2 | 1-2C | 695 | 680 | 2.0 | 700 | 200 | 670 | 280 |
| 1-3 | 1-3C | 670 | 650 | 3.4 | 700 | 200 | 650 | 340 |

As apparent from Table 1–3, the fluorene compounds of the formula (1) for use in the photosensitive members according to the present invention provided a high photosensitivity (i.e., a low $E_{1/5}$) and an excellent potential stability (i.e., a decreased fluctuations of $V_D$ and $V_L$) when repetitively used, compared with the comparative compounds.

EXAMPLE 1-9

A coating liquid for a CGL was prepared by dispersing 1.0 g of τ-type nonmetallophthalocyanine in a solution of 0.4 g of a phenoxy resin in 50 g of cyclohexanone for 40 hours. The coating liquid was applied onto an aluminum sheet by a wire bar and dried for 0.5 hour at 80° C. to form a 0.2 μm-thick CGL.

Then, 1.0 g of a fluorene compound (1-5) and 1.0 g of a bisphenol Z-type polycarbonate resin (Mw=80,000) were dissolved in 7.0 g of monochlorobenzene. The solution was applied onto the CGL by wire bar coating and dried for 1 hour at 120° C. to form a 20 microns-thick CTL, whereby an electrophotographic photosensitive member was obtained.

The thus prepared photosensitive member was charged by corona discharge (−5 KV) so as to have an initial potential of $V_0$, left standing in a dark place for 1 sec, and thereafter the surface potential thereof ($V_1$) was measured. In order to evaluate the sensitivity, the exposure quantity ($E_{1/6}$, μJ/cm$^2$) required for decreasing the potential $V_1$ after the dark decay to 1/6 thereof was measured. The light source used was laser light (output: 5 mW, emission wavelength: 780 nm) emitted from a semiconductor comprising gallium/aluminum/arsenic.

The results were as follows:

$V_0$: −700 V $V_1$: −695 V $E_{1/6}$: 0.45 μJ/cm$^2$

The above-mentioned photosensitive member was assembled in a laser beam printer (trade name: LBP-CX, mfd. by Canon K.K.) as an electrophotographic printer equipped with the above-mentioned semiconductor laser using a reversal development system, and subjected to image formation.

The image formation conditions used herein were as follows:

surface potential after primary charging: −700 V
surface potential after image exposure: −150 V
transfer potential: +700 V
polarity of developing: negative
process speed: 50 mm/sec
developing condition (developing bias): −450 V
image exposure scanning system:
image scan exposure prior to the primary charging: 22.0 lux.sec
(whole surface exposure using red light)

When successive image formation of 3,000 sheets was conducted, good prints were stably obtained from an initial stage to a stage after copying of 3,000 sheets.

EXAMPLE 1-10

A coating liquid was prepared by dispersing 1.0 g of 4-(4-dimethylaminophenyl)-2,6-diphenylthiapyrylium perchlorate and 10 g of a fluorene compound (1-7) in a solution of 10 g of a polyester copolymer (Mw=100,000) in 100 g of a mixture solvent of toluene/dioxane (1/1 by weight) for 20 hours by a ball mill. The coating liquid was applied onto an aluminum sheet by a wire bar and dried for 1 hour at 120° C. to form a photosensitive layer, whereby an electrophotographic photosensitive member was obtained.

The thus-prepared photosensitive member was evaluated in the same manner as in Example 1-1, whereby the results shown in Table 4 were obtained.

TABLE 4

| Ex. | $V_0$ (−V) | $V_1$ (−V) | $E_{1/5}$ (lux · sec) | Initial $V_D$ (−V) | Initial $V_L$ (−V) | After 5,000 sheets $V_D$ (−V) | After 5,000 sheets $V_L$ (−V) |
|---|---|---|---|---|---|---|---|
| 1-10 | 670 | 660 | 1.20 | 700 | 200 | 650 | 240 |

EXAMPLE 1-11

A 2%-solution of an alcohol-soluble nylon resin (nylon 6-66-610-12 tetrapolymer) in methanol was applied onto an aluminum substrate and dried to form an undercoating layer having a thickness of 0.5 μm.

1.0 g of a trisazo pigment of the formula:

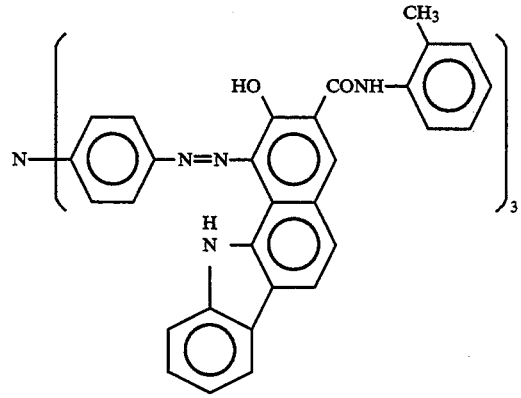

was dispersed in 20 ml of tetrahydrofuran by a sand mill.

A solution of 10 g of a fluorene compound (1-8) and 10 g of a bisphenol A-type polycarbonate resin (Mw=20,000) in 70 g of a mixture solvent of monochlorobenzene/dichloromethane (4/1 by weight) was prepared and added to the above dispersion, followed by dispersion for further 2 hours by means of a sand mill. The resultant dispersion was applied onto the undercoating layer by wire bar coating and dried to form a 16 μm-thick photosensitive layer, whereby an electrophotographic photosensitive member was obtained.

The thus-prepared photosensitive member was evaluated in the same manner as in Example 1-9, whereby the following results were obtained.

$V_0$: −710 V
$V_1$: −690 V
$E_{1/6}$: 0.74 μJ/cm$^2$

EXAMPLE 2-1

On an aluminum sheet, a 0.2 μm-thick undercoating layer comprising a vinyl chloride/maleic anhydride/vinyl acetate copolymer was formed.

Then, 5 g of all example pigment A-(1) synthesized through a method disclosed in Japanese Laid-Open Patent Application (JP-A) No. 17066/1989 was added to a solution of 2 g of a butyral resin (butyral degree of 65 mol %, number-average molecular weight (Mn)=25,000) in 95 ml of cyclohexanone, followed by dispersion for 25 hours by means of a sand mill. The dispersion was applied onto the undercoating layer by a wire bar and dried to form a 0.5 μm-thick CGL.

Subsequently, 5 g of a fluorene compound (14) and 5 g of a bisphenol Z-type polycarbonate resin (viscosity-average molecular weight=30,000) were dissolved in 70 ml of monochlorobenzene and applied onto the CGL by a wire bar, followed by drying to form a 18 μm-thick CTL.

The thus-prepared electrophotographic photosensitive member was subjected to measurement of $V_0$, $V_1$ and $E_{1/5}$ in the same manner as in Example 1-1 except that a corona charging of −5.5 KV and an illuminance of 2 lux with a halogen lamp were employed.

The results are shown below.

$V_0$: −720 V
$V_1$: −705 V
$E_{1/5}$: 0.45 lux.sec

Then, the photosensitive member was attached to a cylinder of an electrophotographic copying apparatus including a corona charger (−5.6 KV), an exposure optical system, a developing means, a transfer charger, an exposure optical system for erasing a residual charge, and a cleaner and subjected to image formation of 10,000 sheets under environmental conditions (relative humidity (%)/temperature (°C.)) of 10%/5° C., 50%/18° C. and 80%/35° C., respectively.

Under the above three conditions, good and faithful copying images were obtained. The images obtained were free from image blur or image defects even after 10,000 sheets of image formation. Thus, the photosensitive member of the present invention showed good image-forming characteristics.

EXAMPLES 2-2 to 2-10

Electrophotographic photosensitive members were prepared and evaluated in the same manner as in Example 2-1 except that the example pigment A-(1) and the fluorene compound (1-4) were charged to those shown in Table 5 appearing hereinafter. The results are shown in Table 5.

In order to evaluate fluctuations of a light part potential ($V_L$) and a dark part potential ($V_D$), the above photosensitive member was attached to a cylinder of an electrophotographic copying apparatus identical to one used in Example 2-1 and subjected to a copying test (or a durability test) of 10,000 sheets on condition that $V_D$ and $V_L$ at an initial stage were set to −700 V and −200 V, respectively. After the copying test of 10,000 sheets, $V_D$ and $V_L$ were measured to evaluate the fluctuations of $\Delta V_D$ and $\Delta V_L$ by subtracting those from $V_D$ and $V_L$ at the initial stage, respectively.

The results are shown in Table 6 below.

TABLE 5

| Ex. | Ex. Pigment | Fluorene Comp. |
|---|---|---|
| 2-2 | A-1 | 1-12 |
| 2-3 | A-1 | 1-5 |
| 2-4 | A-1 | 1-8 |
| 2-5 | A-1 | 1-14 |
| 2-6 | A-3 | 1-4 |
| 2-7 | A-3 | 1-8 |
| 2-8 | A-7 | 1-4 |
| 2-9 | A-7 | 1-3 |
| 2-10 | A-8 | 1-10 |

TABLE 6

| Ex. | $E_{1/5}$ (lux · sec) | $\Delta V_D$ (V) | $\Delta V_L$ (V) |
|---|---|---|---|
| 2-2 | 0.54 | −15 | +20 |
| 2-3 | 0.47 | −7 | +5 |
| 2-4 | 0.46 | −10 | +6 |
| 2-5 | 0.60 | −15 | +18 |
| 2-6 | 0.63 | −12 | +10 |
| 2-7 | 0.62 | −10 | +5 |
| 2-8 | 0.60 | −12 | +5 |
| 2-9 | 0.65 | −15 | +20 |
| 2-10 | 0.65 | −17 | +12 |

COMPARATIVE EXAMPLES 2-1 TO 2-4

Electrophotographic photosensitive members were prepared and evaluated in the same manner as in Example 2-2 except that the fluorene compound (1-12) was changed to the following comparative compounds (2-1C), (2-2C), (2-3C) and (2-4C), respectively.

Comparative Comp.

(2-1C)

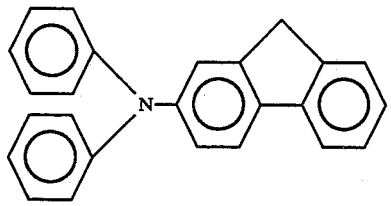

(2-2C)

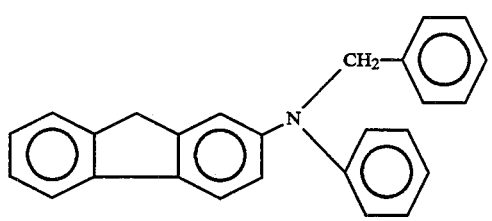

-continued

Comparative Comp.

(2-3C)

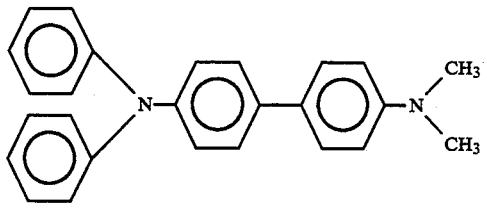

(2-4C)

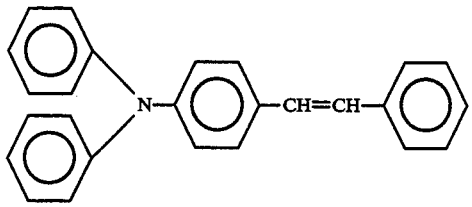

The results are shown in Table 7.

TABLE 7

| Comp. Ex. | $E_{1/5}$ (lux · sec) | $\Delta V_D$ (V) | $\Delta V_L$ (V) |
|---|---|---|---|
| 2-1 | 1.8 | −60 | +62 |
| 2-2 | 3.4 | −48 | +55 |
| 2-3 | 2.2 | −68 | +80 |
| 2-4 | 2.6 | −45 | +70 |

COMPARATIVE EXAMPLES 2-5 TO 2-10

Electrophotographic photosensitive members were prepared and evaluated in the same manner as in Example 2-2 except that example pigments and comparative compounds were used in combination indicated in Table 8 below. The results are shown in Table 9 below.

TABLE 8

| Comp. Ex. | Ex. Pigment | Fluorene Comp. |
|---|---|---|
| 2-5 | A-3 | 2-1C |
| 2-6 | A-3 | 2-2C |
| 2-7 | A-3 | 2-4C |
| 2-8 | A-7 | 2-1C |
| 2-9 | A-7 | 2-3C |
| 2-10 | A-8 | 2-2C |

TABLE 9

| Comp. Ex. | $E_{1/5}$ (lux · sec) | $\Delta V_D$ (V) | $\Delta V_L$ (V) |
|---|---|---|---|
| 2-5 | 3.6 | −60 | +75 |
| 2-6 | 4.2 | −40 | +85 |
| 2-7 | 3.8 | −80 | +40 |
| 2-8 | 4.4 | −55 | +115 |
| 2-9 | 4.2 | −72 | +80 |
| 2-10 | 4.9 | −60 | +60 |

EXAMPLE 3-1

On an aluminum sheet, a 0.2 μm-thick undercoating layer comprising a vinyl chloride/maleic anhydride/vinyl acetate copolymer was formed.

Then, 5 g of an example azo pigment B-(1) was added to a solution of 2 g of a butyral resin (butyral degree of 64 mol %, Mn=30,000) in 95 ml of cyclohexanone, followed by dispersion for 16 hours by means of a sand mill. The dispersion was applied onto the undercoating layer by a wire bar and dried to form a 0.4 μm-thick CGL.

On the CGL, a CTL was formed in the same manner as in Example 2-1 except that the thickness of the CTL was changed to 19 μm, whereby an electrophotographic photosensitive member was obtained.

The thus-prepared photosensitive member was evaluated in the same manner as in Example 2-1, whereby the following results were obtained.

$V_0$: −705 V $V_1$: −696 V $E_{1/5}$: 1.62 lux.sec

Under the above three conditions, good and faithful copying images were obtained. The images obtained were free from image blur or image defects even after 10,000 sheets of image formation. Thus, the photosensitive member of the present invention showed good image-forming characteristics.

EXAMPLES 3-2 TO 3-8

Electrophotographic photosensitive members were prepared in the same manner as in Example 3-1 and evaluated in the same manner as in Example 2-2 except that combinations of example azo pigments (B-1), (B-2) and (B-3) and fluorene compounds indicated in Table 10 below was employed.

TABLE 10

| Ex. | Ex. azo pigment | Fluorene comp. |
|---|---|---|
| 3-2 | B-1 | 1-12 |
| 3-3 | B-1 | 1-5 |
| 3-4 | B-1 | 1-1 |
| 3-5 | B-2 | 1-4 |
| 3-6 | B-2 | 1-1 |
| 3-7 | B-3 | 1-8 |
| 3-8 | B-3 | 1-14 |

The results are shown in Table 11.

TABLE 11

| Ex. | $E_{1/5}$ (lux · sec) | $\Delta V_D$ (V) | $\Delta V_L$ (V) |
|---|---|---|---|
| 3-2 | 1.82 | −17 | +26 |
| 3-3 | 1.59 | −5 | +1 |
| 3-4 | 1.92 | −18 | +25 |
| 3-5 | 1.46 | ±0 | +2 |
| 3-6 | 1.92 | −16 | +22 |
| 3-7 | 1.65 | −2 | −8 |
| 3-8 | 1.94 | −15 | +18 |

COMPARATIVE EXAMPLES 3-1 TO 3-4

Electrophotographic photosensitive members were prepared and evaluated in the same manner as in Example 3-2 except that the fluorene compound (1-12) was changed to the following comparative compounds (3-1C), (3-2C), (3-3C) and (3-4C), respectively.

Comparative Comp.

(3-1C)

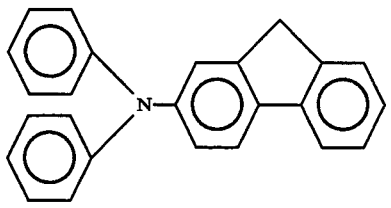

-continued

Comparative Comp.

(3-2C)

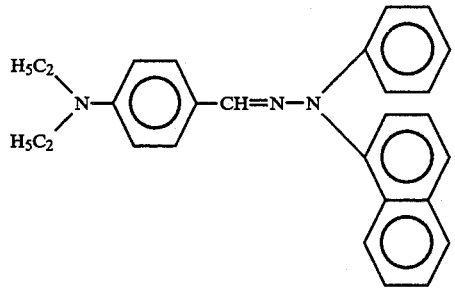

(3-3C)

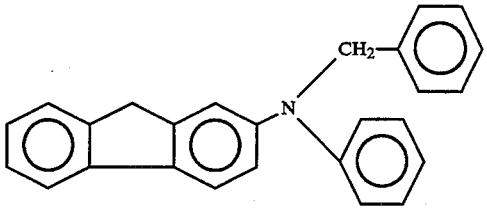

(3-4C)

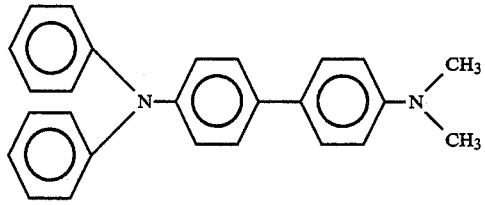

The results are shown in Table 12.

TABLE 12

| Comp. Ex. | $E_{1/5}$ (lux · sec) | $\Delta V_D$ (V) | $\Delta V_L$ (V) |
|---|---|---|---|
| 3-1 | 2.9 | −32 | +105 |
| 3-2 | 3.1 | −26 | +53 |
| 3-3 | 7.8 | −35 | +80 |
| 3-4 | 3.3 | −40 | +75 |

COMPARATIVE EXAMPLES 3-5 TO 3-10

Electrophotographic photosensitive members were prepared and evaluated in the same manner as in Example 3-2except that example pigments and comparative compounds were used in combination indicated in Table 13 below. The results are shown in Table 14 below.

TABLE 13

| Comp. Ex. | Ex. azo pigment | Comparative comp. |
|---|---|---|
| 3-5 | B-2 | (3-1C) |
| 3-6 | B-2 | (3-2C) |
| 3-7 | B-2 | (3-3C) |
| 3-8 | B-3 | (3-2C) |
| 3-9 | B-3 | (3-3C) |
| 3-10 | B-3 | (3-4C) |

TABLE 14

| Comp. Ex. | $E_{1/5}$ (lux · sec) | $\Delta V_D$ (V) | $\Delta V_L$ (V) |
|---|---|---|---|
| 3-5 | 6.8 | −35 | +75 |
| 3-6 | 7.4 | −42 | +65 |
| 3-7 | 8.1 | −30 | +80 |
| 3-8 | 7.6 | −45 | +50 |
| 3-9 | 7.9 | −32 | +62 |

TABLE 14-continued

| Comp. Ex. | $E_{1/5}$ (lux · sec) | $\Delta V_D$ (V) | $\Delta V_L$ (V) |
|---|---|---|---|
| 3-10 | 6.7 | −38 | +65 |

EXAMPLE 4-1

On an aluminum sheet, a 0.1 μm-thick undercoating layer comprising a vinyl chloride/maleic anhydride/vinyl acetate copolymer was formed.

Then, 5 g of an example pigment C-(3) was added to a solution of 2 g of a butyral resin (butyral degree of 63 mol %, Mn=20,000) in 95 ml of cyclohexanone, followed by dispersion for 20 hours by means of a sand mill. The dispersion was applied onto the undercoating layer by a wire bar and dried to form a 0.3 μm-thick CGL.

On the CGL, a CTL was formed in the same manner as in Example 2-1 except that the thickness of the CTL was changed to 19 μm, whereby an electrophotographic photosensitive member was obtained.

The thus-prepared photosensitive member was evaluated in the same manner as in Example 2-1, whereby the following results were obtained.

$V_0$: −701V $V_1$: −698 V $E_{1/5}$: 0.85 lux.sec

Under the above three conditions, good and faithful copying images were obtained. The images obtained were free from image blur or image defects even after 10,000 sheets of image formation. Thus, the photosensitive member of the present invention showed good image-forming characteristics.

EXAMPLES 4-2 TO 4-28

Electrophotographic photosensitive members were prepared in the same manner as in Example 4-1 and evaluated in the same manner as in Example 2-2 except that combinations of example pigments and fluorene compounds indicated in Table 15 below was employed.

TABLE 15

| Ex. | Ex. Pigment | Fluorene Comp. |
|---|---|---|
| 4-2 | C-1 | 1-12 |
| 4-3 | C-1 | 1-4 |
| 4-4 | C-1 | 1-5 |
| 4-5 | C-1 | 1-1 |
| 4-6 | C-2 | 1-5 |
| 4-7 | C-2 | 1-1 |
| 4-8 | C-2 | 1-8 |
| 4-9 | C-3 | 1-4 |
| 4-10 | C-3 | 1-5 |
| 4-11 | C-3 | 1-8 |
| 4-12 | C-3 | 1-15 |
| 4-13 | C-5 | 1-5 |
| 4-14 | C-5 | 1-1 |
| 4-15 | C-5 | 1-13 |
| 4-16 | C-6 | 1-4 |
| 4-17 | C-6 | 1-8 |
| 4-18 | C-6 | 1-14 |
| 4-19 | C-8 | 1-12 |
| 4-20 | C-8 | 1-4 |
| 4-21 | C-10 | 1-8 |
| 4-22 | C-12 | 1-5 |
| 4-23 | C-16 | 1-1 |
| 4-24 | C-18 | 1-8 |
| 4-25 | C-18 | 1-3 |
| 4-26 | C-19 | 1-12 |
| 4-27 | C-19 | 1-4 |
| 4-28 | C-20 | 1-5 |

TABLE 16

| Ex. | $E_{1/5}$ (lux · sec) | $\Delta V_D$ (V) | $\Delta V_L$ (V) |
|---|---|---|---|
| 4-2 | 0.98 | −17 | +20 |
| 4-3 | 0.87 | −8 | +6 |
| 4-4 | 0.80 | −7 | +5 |
| 4-5 | 1.01 | −16 | +18 |
| 4-6 | 0.81 | −6 | +6 |
| 4-7 | 1.04 | −13 | +21 |
| 4-8 | 0.92 | −5 | +8 |
| 4-9 | 0.94 | −5 | +8 |
| 4-10 | 0.89 | −5 | −3 |
| 4-11 | 0.95 | −8 | +10 |
| 4-12 | 1.12 | −16 | +28 |
| 4-13 | 0.90 | +3 | +8 |
| 4-14 | 1.15 | −16 | +15 |
| 4-15 | 1.18 | −13 | +25 |
| 4-16 | 0.87 | −3 | −5 |
| 4-17 | 0.88 | ±0 | +5 |
| 4-18 | 1.14 | −15 | +17 |
| 4-19 | 0.98 | −8 | +26 |
| 4-20 | 0.94 | +8 | +10 |
| 4-21 | 1.06 | −6 | +8 |
| 4-22 | 0.97 | −8 | +6 |
| 4-23 | 1.12 | −8 | +15 |
| 4-24 | 1.10 | −5 | −5 |
| 4-25 | 1.34 | −18 | +18 |
| 4-26 | 1.48 | −16 | +28 |
| 4-27 | 1.12 | −5 | −5 |
| 4-28 | 0.97 | −5 | −5 |

COMPARATIVE EXAMPLES 4-1 TO 4-4

Electrophotographic photosensitive members were prepared and evaluated in the same manner as in Example 4-2 except that the fluorene compound (1-12) was changed to the following comparative compounds (4-1C), (4-2C), (4-3C) and (4-4C), respectively.

Comparative Comp.

(4-1)

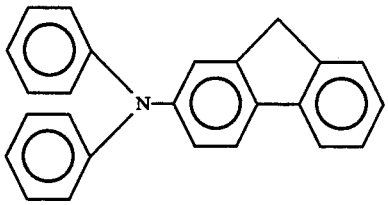

(4-2)

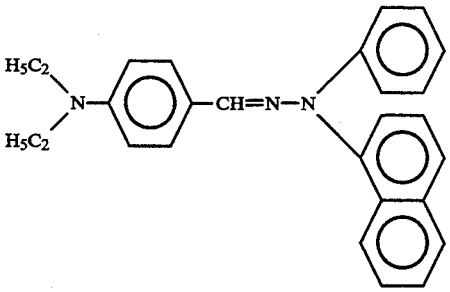

(4-3)

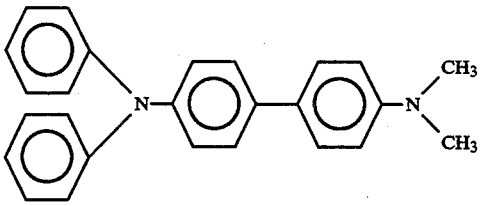

-continued

Comparative Comp.

(4-4)

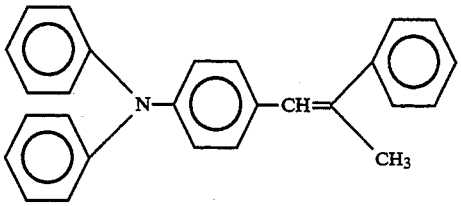

The results are shown in Table 17.

TABLE 17

| Comp. Ex. | $E_{1/5}$ (lux · sec) | $\Delta V_D$ (V) | $\Delta V_L$ (V) |
|---|---|---|---|
| 4-1 | 3.6 | −45 | +60 |
| 4-2 | 5.2 | −40 | +55 |
| 4-3 | 3.2 | −30 | +88 |
| 4-4 | 4.8 | −38 | +105 |

COMPARATIVE EXAMPLES 4-5 TO 4-16

Electrophotographic photosensitive members were prepared and evaluated in the same manner as in Example 4-2 except that example pigments and comparative compounds were used in combination indicated in Table 18 below. The results are shown in Table 19 below.

TABLE 18

| Comp. Ex. | Ex. Pigment | Comparative Comp. |
|---|---|---|
| 4-5 | C-2 | 4-1C |
| 4-6 | C-2 | 4-2C |
| 4-7 | C-3 | 4-1C |
| 4-8 | C-3 | 4-2C |
| 4-9 | C-3 | 4-4C |
| 4-10 | C-5 | 4-2C |
| 4-11 | C-5 | 4-3C |
| 4-12 | C-6 | 4-3C |
| 4-13 | C-6 | 4-4C |
| 4-14 | C-8 | 4-1C |
| 4-15 | C-8 | 4-3C |
| 4-16 | C-20 | 4-2C |

TABLE 19

| Comp. Ex. | $E_{1/5}$ (lux · sec) | $\Delta V_D$ (V) | $\Delta V_L$ (V) |
|---|---|---|---|
| 4-5 | 4.2 | −42 | +65 |
| 4-6 | 5.6 | −50 | +85 |
| 4-7 | 4.4 | −38 | +48 |
| 4-8 | 5.2 | −46 | +68 |
| 4-9 | 4.0 | −50 | +75 |
| 4-10 | 5.0 | −65 | +50 |
| 4-11 | 4.2 | −55 | +58 |
| 4-12 | 4.6 | −55 | +50 |
| 4-13 | 4.6 | −40 | +85 |
| 4-14 | 4.0 | −40 | +52 |
| 4-15 | 4.4 | −35 | +65 |
| 4-16 | 5.2 | −70 | +50 |

EXAMPLE 5-1

A coating liquid for a charge generation layer (CGL) was prepared by adding 3.9 g of a bisazo pigment of the formula:

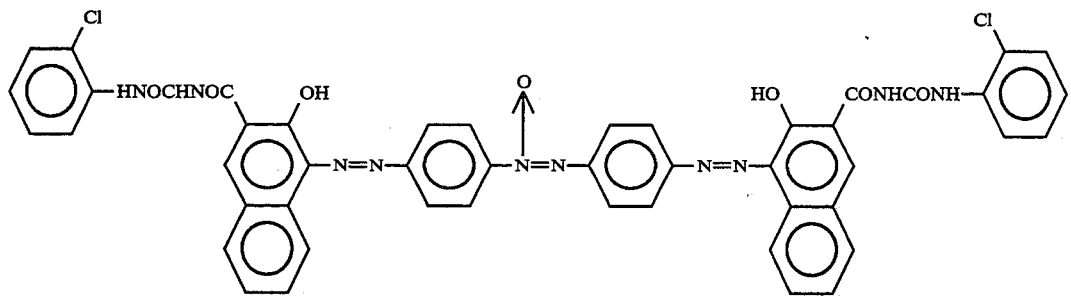

to a solution of 2.1 g of a butyral resin (butyral degree of 70 mol. %) in 95 ml of cyclohexanone and dispersing for 37 hours by means of a sand mill.

The coating liquid for the CGL was applied onto an aluminum sheet by a wire bar and dried to obtain a 0.18 μm-thick CGL.

Subsequently, a solution of 8 g of a fluorene compound (2-3), 2 g of a triphenylamine compound (3-37) and 8.33 g of a polycarbonate resin (Mw=33,000) in 70 g of monochlorobenzene was prepared and applied onto the CGL by wire bar coating, followed by drying to obtain a 19 μm-thick CTL to prepare an electrophotographic photosensitive member.

The thus-prepared photosensitive member was evaluated in the same manner as in Example 1-1 except for conducting a copying test of 3,000 sheets. The results are shown in Table 20 appearing hereinafter.

The photosensitive member was also subjected to an accelerated test of a crack in a photosensitive layer and an accelerated test of crystallization of a charge-transporting material as follows.

Crack

The surface of a testings photosensitive member is touched or pressed by a finger to attach a fatty component of the finger to the surface of the photosensitive member, followed by standing for 32 hours under normal temperature and normal pressure. After a lapse of a prescribed hour, the touched part of the photosensitive member is subjected to observation with a microscope (VERSAMET 6390, manufactured by Union Corp.; magnification=50) whether or crack is generated or not.

Crystallization

The above-treated photosensitive member with a finger is left standing for 2 weeks at 75° C. After a lapse of a prescribed day, the touched part of the photosensitive member is subjected to observation with the above-mentioned microscope (magnification of 50) whether an crystallization is generated or not.

The results are also shown in Table 20 appearing hereinafter.

EXAMPLES 5-2 TO 5-18 AND COMPARATIVE EXAMPLES 5-1 TO 5-13

Electrophotographic photosensitive members were prepared and evaluated in the same manner as in Example 5-1 except for using compounds in the indicated proportions shown in Tables 20–24 instead of 8 g of the fluorene compound (2-3) and 2 g of the triphenylamine compound (3-37), respectively.

In comparative Example 5-2, the following comparative compound (5-1C) was used.

Comparative comp.

(5-1C)

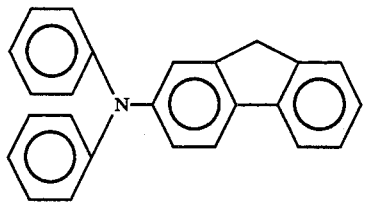

The results are shown in Tables 20–24 below.

TABLE 20

| Ex. | Ex. Comp. | Weight | (melting point) | Initial $V_0$ (−V) | Initial $V_1$ (−V) | $E_{1/5}$ (lux · sec) | After 3,000 sheets $\Delta V_D$ (V) | After 3,000 sheets $\Delta V_L$ (V) | Crack 1 hr | Crack 4 hr | Crack 16 hr | Crack 32 hr | Crystallization 1 day | Crystallization 3 day | Crystallization 7 day | Crystallization 14 day |
|---|---|---|---|---|---|---|---|---|---|---|---|---|---|---|---|---|
| 5-1 | No. (2-3) | 8 g | | 698 | 694 | 1.5 | −15 | +5 | ○ | ○ | ○ | ○ | ○ | ○ | ○ | ○ |
| | No. (3-37) | 2 g | (mp. 129° C.) | | | | | | | | | | | | | |
| 5-2 | No. (2-10) | 9 g | | 705 | 700 | 1.4 | −5 | +7 | ○ | ○ | ○ | ○ | ○ | ○ | ○ | ○ |
| | No. (3-6) | 1 g | (mp. 82° C.) | | | | | | | | | | | | | |
| 5-3 | No. (2-10) | 8 g | | 704 | 701 | 1.5 | −7 | +7 | ○ | ○ | ○ | ○ | ○ | ○ | ○ | ○ |
| | No. (3-47) | 2 g | (mp. 143° C.) | | | | | | | | | | | | | |
| 5-4 | No. (2-16) | 7 g | | 709 | 700 | 1.6 | −8 | +6 | ○ | ○ | ○ | ○ | ○ | ○ | ○ | ○ |
| | No. (3-4) | 3 g | (mp. 70° C.) | | | | | | | | | | | | | |
| 5-5 | No. (2-16) | 8 g | | 695 | 689 | 1.6 | −10 | +11 | ○ | ○ | ○ | ○ | ○ | ○ | ○ | ○ |
| | No. (3-20) | 2 g | (mp. 108° C.) | | | | | | | | | | | | | |
| 5-6 | No. (2-25) | 7 g | | 701 | 689 | 1.3 | −5 | +12 | ○ | ○ | ○ | ○ | ○ | ○ | ○ | ○ |
| | No. (3-24) | 3 g | (mp. 116° C.) | | | | | | | | | | | | | |
| 5-7 | No. (2-25) | 9 g | | 698 | 697 | 1.4 | −5 | +10 | ○ | ○ | ○ | ○ | ○ | ○ | ○ | ○ |
| | No. (3-23) | 1 g | (mp. 116° C.) | | | | | | | | | | | | | |
| 5-8 | No. (2-25) | 5 g | | 702 | 700 | 1.3 | −3 | +8 | ○ | ○ | ○ | ○ | ○ | ○ | ○ | ○ |
| | No. (3-43) | 5 g | (mp. 137° C.) | | | | | | | | | | | | | |
| 5-9 | No. (2-25) | 8 g | | 704 | 701 | 1.5 | −7 | +9 | ○ | ○ | ○ | x | ○ | ○ | ○ | x |

TABLE 20-continued

| Ex. | Ex. Comp. | Weight | (melting point) | Initial $V_0$ (−V) | Initial $V_1$ (−V) | $E_{1/5}$ (lux · sec) | After 3,000 sheets $\Delta V_D$ (V) | After 3,000 sheets $\Delta V_L$ (V) | Crack 1 hr | Crack 4 hr | Crack 16 hr | Crack 32 hr | Crystallization 1 day | Crystallization 3 day | Crystallization 7 day | Crystallization 14 day |
|---|---|---|---|---|---|---|---|---|---|---|---|---|---|---|---|---|
| | No. (3-46) | 2 g | (mp. 142° C.) | | | | | | | | | | | | | |

o: No crack in a photosensitive layer or no crystallization of a CTM occurred.
x: A crack in a photosensitive or a crystallization of a CTM occurred.

TABLE 21

| Ex. | Ex. Comp. | Weight | (melting point) | Initial $V_0$ (−V) | Initial $V_1$ (−V) | $E_{1/5}$ (lux · sec) | After 3,000 sheets $\Delta V_D$ (V) | After 3,000 sheets $\Delta V_L$ (V) | Crack 1 hr | Crack 4 hr | Crack 16 hr | Crack 32 hr | Crystallization 1 day | Crystallization 3 day | Crystallization 7 day | Crystallization 14 day |
|---|---|---|---|---|---|---|---|---|---|---|---|---|---|---|---|---|
| 5-10 | No. (2-25) | 8 g | | 705 | 699 | 1.4 | −10 | +3 | o | o | o | o | o | o | o | o |
| | No. (3-50) | 2 g | (mp. 145° C.) | | | | | | | | | | | | | |
| 5-11 | No. (2-43) | 7 g | | 694 | 690 | 1.4 | −10 | +3 | o | o | o | o | o | o | o | o |
| | No. (3-3) | 3 g | (mp. 63° C.) | | | | | | | | | | | | | |
| 5-12 | No. (2-43) | 8 g | | 698 | 696 | 1.4 | −8 | +5 | o | o | o | o | o | o | | |
| | No. (3-19) | 2 g | (mp. 107° C.) | | | | | | | | | | | | | |
| 5-13 | No. (2-43) | 2 g | | 699 | 692 | 1.7 | −7 | +8 | o | o | o | o | o | o | o | o |
| | No. (3-28) | 8 g | (mp. 121° C.) | | | | | | | | | | | | | |

TABLE 22

| Ex. | Ex. Comp. | Weight | (melting point) | Initial $V_0$ (−V) | Initial $V_1$ (−V) | $E_{1/5}$ (lux · sec) | After 3,000 sheets $\Delta V_D$ (V) | After 3,000 sheets $\Delta V_L$ (V) | Crack 1 hr | Crack 4 hr | Crack 16 hr | Crack 32 hr | Crystallization 1 day | Crystallization 3 day | Crystallization 7 day | Crystallization 14 day |
|---|---|---|---|---|---|---|---|---|---|---|---|---|---|---|---|---|
| 5-14 | No. (2-11) | 8 g | | 695 | 690 | 1.5 | −15 | +15 | o | o | o | o | o | o | o | o |
| | No. (3-2) | 2 g | (mp. oily) | | | | | | | | | | | | | |
| 5-15 | No. (2-18) | 7 g | | 684 | 682 | 1.6 | −8 | +7 | o | o | o | o | o | o | o | o |
| | No. (3-7) | 3 g | (mp. 93° C.) | | | | | | | | | | | | | |
| 5-16 | No. (2-29) | 6 g | | 701 | 699 | 1.4 | −7 | +8 | o | o | o | o | o | o | o | o |
| | No. (3-3) | 4 g | (mp. 63° C.) | | | | | | | | | | | | | |
| 5-17 | No. (2-36) | 7 g | | 703 | 699 | 1.5 | −3 | +7 | o | o | o | o | o | o | o | o |
| | No. (3-11) | 3 g | (mp. 99° C.) | | | | | | | | | | | | | |
| 5-18 | No. (2-53) | 7 g | | 700 | 689 | 1.5 | −5 | +8 | o | o | o | x | o | o | o | o |
| | No. (3-52) | 3 g | (mp. 147° C.) | | | | | | | | | | | | | |

TABLE 23

| Ex. | Ex. Comp. | Weight | (melting point) | Initial $V_0$ (−V) | Initial $V_1$ (−V) | $E_{1/5}$ (lux · sec) | After 3,000 sheets $\Delta V_D$ (V) | After 3,000 sheets $\Delta V_L$ (V) | Crack 1 hr | Crack 4 hr | Crack 16 hr | Crack 32 hr | Crystallization 1 day | Crystallization 3 day | Crystallization 7 day | Crystallization 14 day |
|---|---|---|---|---|---|---|---|---|---|---|---|---|---|---|---|---|
| 5-1 | No. (3-35) | 8 g | | +700 | +695 | 1.7 | −28 | +35 | o | x | — | — | o | o | x | — |
| | No. (3-20) | 2 g | (mp. 108° C.) | | | | | | | | | | | | | |
| 5-2 | No. (5-1C) | 7 g | | +705 | +682 | 1.6 | −35 | +40 | o | o | x | — | o | o | x | — |
| | No. (3-4) | 3 g | (mp. 70° C.) | | | | | | | | | | | | | |
| 5-3 | No. (3-55) | 9 g | | +703 | +691 | 1.5 | −63 | +38 | o | x | — | — | o | x | — | — |
| | No. (3-6) | 1 g | (mp. 83° C.) | | | | | | | | | | | | | |
| 5-4 | No. (2-25) | 5 g | | +701 | +699 | 1.3 | −39 | +50 | o | x | — | — | o | x | — | — |
| | No. (3-62) | 5 g | (mp. 168° C.) | | | | | | | | | | | | | |
| 5-5 | No. (2-25) | 8 g | | +685 | +684 | 1.4 | −50 | +40 | x | — | — | — | o | x | — | — |
| | No. (3-65) | 2 g | (mp. 177° C.) | | | | | | | | | | | | | |
| 5-6 | No. (2-3) | 8 g | | +692 | +687 | 1.5 | −45 | +35 | x | — | — | — | x | — | — | — |
| | No. (3-70) | 2 g | (mp. 187° C.) | | | | | | | | | | | | | |
| 5-7 | No. (2-12) | 10 g | | +710 | +699 | 1.4 | −42 | +51 | o | x | — | — | o | o | x | — |
| 5-8 | No. (2-47) | 10 g | | +704 | +697 | 1.4 | −70 | +60 | o | x | — | — | o | x | — | — |
| 5-9 | No. (2-27) | 10 g | | +700 | +694 | 1.5 | −60 | +50 | o | x | — | — | x | — | — | — |

TABLE 24

| Comp. Ex. | Ex. Comp. | Weight | (melting point) | Initial $V_0$ (−V) | Initial $V_1$ (−V) | $E_{1/5}$ (lux · sec) | After 3,000 sheets $\Delta V_D$ (V) | After 3,000 sheets $\Delta V_L$ (V) | Crack 1 hr | Crack 4 hr | Crack 16 hr | Crack 32 hr | Crystallization 1 day | Crystallization 3 day | Crystallization 7 day | Crystallization 14 day |
|---|---|---|---|---|---|---|---|---|---|---|---|---|---|---|---|---|
| 5-10 | No. (3-17) | 10 g | | +694 | +690 | 1.7 | −54 | +48 | o | o | o | x | o | o | x | — |
| 5-11 | No. (3-46) | 10 g | | +697 | +691 | 1.4 | −48 | +55 | o | x | — | — | o | o | x | — |
| 5-12 | No. (3-65) | 10 g | | +696 | +694 | 1.7 | −52 | +58 | o | x | — | — | o | x | — | — |
| 5-13 | No. (3-80) | 10 g | | +710 | +700 | 2.0 | −65 | +54 | x | — | — | — | x | — | — | — |

As apparent from Tables 20–24, the photosensitive members according to the present invention provided

EXAMPLE 5-19

Onto an aluminum substrate, a solution of 4.8 g of an N-methoxymethylated 6-nylon resin (Mw=35,000) and 9.0 g of an alcohol-soluble copolymer nylon resin (Mw=30,000) in 75 g of methanol was applied by means of a wire bar, followed by drying to form a 0.9 micron-thick undercoating layer.

Separately, 6.0 g of oxytitanium phthalocyanine was added to a solution of 5.0 g of a phenoxy resin in 175 g of cyclohexanone and the resultant mixture was dispersed for 36 hours in a ball mill. The liquid dispersion was applied onto the undercoating layer by blade coating, followed by drying to form a 0.19 micron-thick CGL.

Then, 7 g of a fluorene compound (2-25), 3 g of a triphenylamine compound (3-3) and 8.33 g of a styrene-acrylate (8:2) copolymer (Mw=25,000) were dissolved in 65 g of monochlorobenzene. The solution was applied onto the CGL by blade coating and dried to form a 20 microns-thick CTL to prepare an electrophotographic photosensitive member.

The thus prepared photosensitive member was charged by using corona discharge (−5 KV) so as to have an initial potential of $V_0$, left standing in a dark place for 1 sec, and thereafter the surface potential thereof ($V_1$) was measured. In order to evaluate a photosensitivity, the exposure quantity ($E_{1/6}$, $\mu J/cm^2$) required for decreasing the potential $V_1$ after the dark decay to 1/6 thereof was measured. The light source used herein was laser light (output: 5 mW, emission wavelength: 780 nm) emitted from a ternary semiconductor comprising gallium/aluminum/arsenic.

The above-mentioned photosensitive member was assembled in a laser beam printer (trade name: LBP-SX, mfd. by Canon K.K.) as an electrophotographic printer equipped with the above-mentioned semiconductor laser using a reversal development system, and subjected to measurement of a voltage ($V_{d1}$) of a primary charging under no transfer current application and a voltage ($V_{d2}$) of the primary charging under transfer current application to evaluate a transfer memory ($V_{d1}-V_{d2}$) and then subjected to image formation.

The image formation conditions used herein were as follows:

surface potential after primary charging: −700 V
surface potential after image exposure: −150 V
(exposure quantity: 1.0 $\mu J/cm^2$)
transfer potential: +700 V
polarity of developing: negative
process speed: 47 mm/sec
developing condition (developing bias): −450 V
image exposure scanning system:
image scan exposure prior to the primary charging: 8.0 lux.sec
(whole surface exposure using red light)

The image formation was effected by line-scanning the laser beam corresponding to character and image signals. As a result, good prints were obtained with respect to the characters and images.

Separately, the photosensitive member was evaluated in respect of a crack and crystallization in the same manner as in Example 5-1.

The results are shown in Table 25 appearing hereinafter.

EXAMPLES 5-20 TO 5-30

Electrophotographic photosensitive members were prepared and evaluated in the same manner as in Example 5-19 except for using compounds in the indicated proportions shown in Tables 25 and 26 instead of 7 g of the fluorene compound (2-25) and 3 g of the triphenylamine compound (3-3), respectively.

The results are shown in Tables 25 and 26 appearing hereinafter.

COMPARATIVE EXAMPLES 5-14 TO 5-22

Electrophotographic photosensitive members were prepared and evaluated in the same manner as in Example 5-19 except for using compounds in the indicated proportions shown in Table 27 instead of 7 g of the fluorene compound (2-25) and 7 g of the triphenylamine compound (3-3), respectively.

In comparative Example 5-21, the following comparative compound (5-1C) was used.

Comparative comp.

(5-1C)

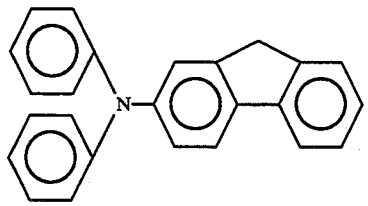

The results are shown in Table 27 below.

TABLE 25

| Ex. | Ex. Comp. | Weight | (melting point) | Initial $V_D$ (−V) | Initial $V_1$ (−V) | Initial $E_{1/6}$ ($\mu$J/cm) | Transfer memory $V_{d1}-V_{d2}$ (−V) | Crack 1 hr | Crack 4 hr | Crack 16 hr | Crack 32 hr | Crystallization 1 day | Crystallization 3 day | Crystallization 7 day | Crystallization 14 day |
|---|---|---|---|---|---|---|---|---|---|---|---|---|---|---|---|
| 5-19 | No. (2-25) | 7 g | | +705 | +700 | 1.4 | 3 | ○ | ○ | ○ | ○ | ○ | ○ | ○ | ○ |
| | No. (3-3) | 3 g | (mp. 63° C.) | | | | | | | | | | | | |
| 5-20 | No. (2-25) | 6 g | | 710 | 704 | 1.4 | 5 | ○ | ○ | ○ | ○ | ○ | ○ | ○ | ○ |
| | No. (3-19) | 4 g | (mp. 107° C.) | | | | | | | | | | | | |
| 5-21 | No. (2-25) | 8 g | | 710 | 707 | 1.5 | 5 | ○ | ○ | ○ | ○ | ○ | ○ | ○ | ○ |
| | No. (3-21) | 2 g | (mp. 111° C.) | | | | | | | | | | | | |
| 5-22 | No. (2-25) | 2 g | | 700 | 698 | 1.7 | 10 | ○ | ○ | ○ | x | ○ | ○ | ○ | ○ |
| | No. (3-55) | 8 g | (mp. 152° C.) | | | | | | | | | | | | |
| 5-23 | No. (2-16) | 7 g | | 704 | 701 | 1.6 | 11 | ○ | ○ | ○ | ○ | ○ | ○ | ○ | ○ |
| | No. (3-48) | 3 g | (mp. 143° C.) | | | | | | | | | | | | |
| 5-24 | No. (2-16) | 6 g | | 703 | 698 | 1.7 | 10 | ○ | ○ | ○ | x | ○ | ○ | ○ | x |
| | No. (3-51) | 4 g | (mp. 146° C.) | | | | | | | | | | | | |
| 5-25 | No. (2-10) | 3 g | | 701 | 695 | 1.7 | 12 | ○ | ○ | ○ | ○ | ○ | ○ | ○ | x |
| | No. (3-49) | 7 g | (mp. 145° C.) | | | | | | | | | | | | |
| 5-26 | No. (2-15) | 8 g | | 700 | 690 | 1.4 | 8 | ○ | ○ | ○ | ○ | ○ | ○ | ○ | ○ |

TABLE 25-continued

| Ex. | Ex. Comp. | Weight | (melting point) | Initial $V_D$ (−V) | Initial $V_1$ (−V) | Initial $E_{1/6}$ (μJ/cm) | Transfer memory $V_{d1} - V_{d2}$ (−V) | Crack 1 hr | Crack 4 hr | Crack 16 hr | Crack 32 hr | Crystallization 1 day | Crystallization 3 day | Crystallization 7 day | Crystallization 14 day |
|---|---|---|---|---|---|---|---|---|---|---|---|---|---|---|---|
| | No. (3-34) | 2 g | (mp. 129° C.) | | | | | | | | | | | | |

o: No crack in a photosensitive layer or no crystallization of a CTM occurred.
x: A crack in a photosensitive layer or a crystallization of a CTM occurred.

TABLE 26

| Ex. | Ex. Comp. | Weight | (melting point) | Initial $V_D$ (−V) | Initial $V_1$ (−V) | Initial $E_{1/6}$ (μJ/cm) | Transfer memory $V_{d1} - V_{d2}$ (−V) | Crack 1 hr | Crack 4 hr | Crack 16 hr | Crack 32 hr | Crystallization 1 day | Crystallization 3 day | Crystallization 7 day | Crystallization 14 day |
|---|---|---|---|---|---|---|---|---|---|---|---|---|---|---|---|
| 5-27 | No. (2-20) | 8 g | | 685 | 680 | 1.6 | 5 | o | o | o | o | o | o | o | o |
| | No. (3-5) | 2 g | (mp. 81° C.) | | | | | | | | | | | | |
| 5-28 | No. (2-23) | 7 g | | 695 | 694 | 1.7 | 0 | o | o | o | o | o | o | o | o |
| | No. (3-9) | 3 g | (mp. 96° C.) | | | | | | | | | | | | |
| 5-29 | No. (2-44) | 6 g | | 700 | 697 | 1.6 | 4 | o | o | o | o | o | o | o | o |
| | No. (3-18) | 4 g | (mp. 106° C.) | | | | | | | | | | | | |
| 5-30 | No. (2-50) | 5 g | | 705 | 703 | 1.9 | 15 | o | o | o | x | o | o | o | x |
| | No. (3-58) | 5 g | (mp. 157° C.) | | | | | | | | | | | | |

TABLE 27

| Comp. Ex. | Ex. Comp. | Weight | (melting point) | Initial $V_D$ (−V) | Initial $V_1$ (−V) | Initial $E_{1/6}$ (μJ/cm) | Transfer memory $V_{d1} - V_{d2}$ (−V) | Crack 1 hr | Crack 4 hr | Crack 16 hr | Crack 32 hr | Crystallization 1 day | Crystallization 3 day | Crystallization 7 day | Crystallization 14 day |
|---|---|---|---|---|---|---|---|---|---|---|---|---|---|---|---|
| 5-14 | No. (3-7) | 8 g | | +707 | +687 | 1.9 | 27 | o | x | — | — | o | o | x | — |
| | No. (3-21) | 2 g | (mp. 111° C.) | | | | | | | | | | | | |
| 5-15 | No. (3-55) | 7 g | | 708 | 691 | 1.8 | 35 | o | o | x | — | o | x | — | — |
| | No. (3-3) | 3 g | (mp. 63° C.) | | | | | | | | | | | | |
| 5-16 | No. (2-25) | 7 g | | 700 | 690 | 1.9 | 39 | o | x | — | — | o | x | — | — |
| | No. (3-71) | 3 g | (mp. 188° C.) | | | | | | | | | | | | |
| 5-17 | No. (2-10) | 7 g | | 700 | 688 | 1.8 | 40 | x | — | — | — | o | x | — | — |
| | No. (3-75) | 3 g | (mp. 195° C.) | | | | | | | | | | | | |
| 5-18 | No. (2-48) | 10 g | | 700 | 695 | 1.6 | 20 | o | x | — | — | o | x | — | — |
| 5-19 | No. (3-51) | 10 g | | 701 | 690 | 1.7 | 32 | o | x | — | — | o | x | — | — |
| 5-20 | No. (3-76) | 10 g | | 697 | 692 | 2.0 | 31 | o | x | — | — | o | o | x | — |
| 5-21 | No. (5-1C) | 10 g | | 695 | 688 | 1.9 | 40 | o | x | — | — | o | x | — | — |
| 5-22 | No. (3-7) | 8 g | | 699 | 691 | 2.1 | 42 | o | x | — | — | o | x | — | — |
| | No. (3-21) | 2 g | (mp. 111° C.) | | | | | | | | | | | | |

EXAMPLES 5-31 TO 5-39

Electrophotographic photosensitive members were prepared and evaluated in the same manner as in Example 5-19 except for using the compounds used in Examples 5-19, 5-20 and 5-24 in the indicated proportions shown in Table 28.

The results are shown in Table 28 below.

TABLE 28

| Comp. Ex. | Ex. Comp. | Weight | (melting point) | Initial $V_D$ (−V) | Initial $V_1$ (−V) | Initial $E_{1/6}$ (μJ/cm) | Transfer memory $V_{d1} - V_{d2}$ (−V) | Crack 1 hr | Crack 4 hr | Crack 16 hr | Crack 32 hr | Crystallization 1 day | Crystallization 3 day | Crystallization 7 day | Crystallization 14 day |
|---|---|---|---|---|---|---|---|---|---|---|---|---|---|---|---|
| 5-31 | No. (2-25) | 8 g | | +701 | +699 | 1.4 | 3 | o | o | o | o | o | o | o | x |
| | No. (3-3) | 2 g | (mp. 63° C.) | | | | | | | | | | | | |
| 5-32 | No. (2-25) | 5 g | | +705 | +699 | 1.4 | 4 | o | o | o | o | o | o | o | o |
| | No. (3-3) | 5 g | (mp. 63° C.) | | | | | | | | | | | | |
| 5-33 | No. (2-25) | 2 g | | +702 | +701 | 1.5 | 6 | o | o | o | o | o | o | o | o |
| | No. (3-3) | 8 g | (mp. 63° C.) | | | | | | | | | | | | |
| 5-34 | No. (2-25) | 7 g | | +699 | +691 | 1.4 | 5 | o | o | o | o | o | o | o | o |
| | No. (3-19) | 3 g | (mp. 107° C.) | | | | | | | | | | | | |
| 5-35 | No. (2-25) | 5 g | | +700 | +697 | 1.4 | 5 | o | o | o | o | o | o | o | o |
| | No. (3-19) | 5 g | (mp. 107° C.) | | | | | | | | | | | | |
| 5-36 | No. (2-25) | 3 g | | +691 | +690 | 1.6 | 7 | o | o | o | o | o | o | o | o |
| | No. (3-19) | 7 g | (mp. 107° C.) | | | | | | | | | | | | |
| 5-37 | No. (2-16) | 9.5 g | | +698 | +696 | 1.7 | 3 | o | o | o | x | o | o | o | x |
| | No. (3-51) | 0.5 g | (mp. 146° C.) | | | | | | | | | | | | |
| 5-38 | No. (2-16) | 7 g | | +699 | +691 | 1.7 | 3 | o | o | o | o | o | o | o | o |
| | No. (3-51) | 3 g | (mp. 146° C.) | | | | | | | | | | | | |
| 5-39 | No. (2-16) | 3 g | | +701 | +700 | 1.9 | 4 | o | o | o | x | o | o | o | o |
| | No. (3-51) | 7 g | (mp. 146° C.) | | | | | | | | | | | | |

EXAMPLE 5-40

A coating liquid was prepared by dispersing 4 g of 4-(4-dimethylaminophenyl)-2,6-diphenylthiapyrylium perchlorate, 1.8 g of a fluorene compound (2-29) and 3.2 g of a triphenylamine compound (3-5) in a solution of 15 g of a polyester copolymer (Mw=48,000) in 100 g of a mixture solvent of a toluene/dioxane (1/1 by weight) for 16 hours by a ball mill. The coating liquid was applied onto an aluminum sheet by a wire bar and dried for 1 hour at 120° C. to form a 13 μm-thick photosensitive layer, whereby an electrophotographic photosensitive member was obtained.

The thus-prepared photosensitive member was evaluated in the same manner as in Example 5-1, whereby the following results were obtained.

$V_0$: −700 V $V_1$: −690 V $E_{1/5}$: 3.5 lux.sec

No crack was generated after 32 hours and no crystallization was observed after 2 weeks.

EXAMPLE 5-41

A 25%-solution of an alcohol-soluble nylon resin (nylon 6-66-610-12 tetrapolymer) in methanol was applied onto an aluminum substrate and dried to form an undercoating layer having a thickness of 1.7 μm.

A solution of 8 g of a fluorene compound (2 -46), 2 g of a triphenylamine compound (3-15) and 10 g of a bisphenol A-type polycarbonate resin (Mw=30,000) in 70 g of a mixture solvent of monochlorobenzene/dichloromethane (6/1 by weight) was prepared and applied onto the above undercoating layer followed by drying to form a 18 μm-thick CTL.

Then, 4 g of a pigment of the formula:

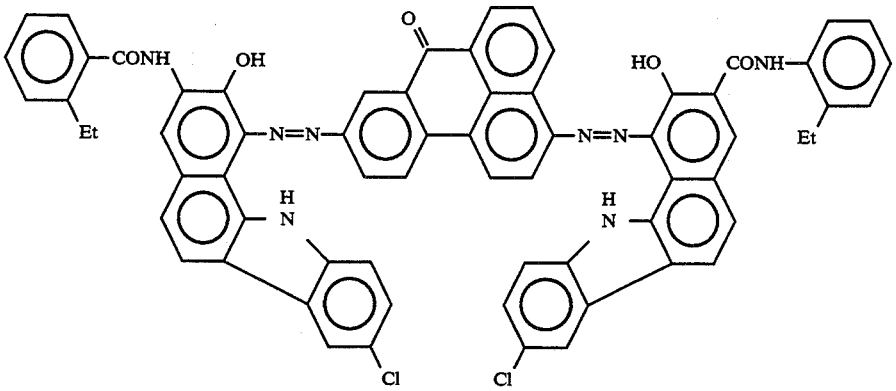

was added to a solution of 2.0 g of a butyral resin (butyral degree=63 mol %) in 75 ml of tetrahydrofuran, followed by stirring for 20 hours in a sand mill. The thus prepared coating liquid was applied onto the CTL by a wire bar and dried to form a 0.90 μm-thick CGL to prepare an electrophotographic photosensitive member.

The thus-prepared photosensitive member was evaluated in respect of charging characteristics in the same manner as in Example 5-1 except that the photosensitive member was positively charged. The results are shown below.

$V_0$: +700 V $V_1$: +697 V $E_{1/5}$: 2.5 lux.sec

EXAMPLE 5-42

Onto a glass substrate, a solution of 5 g of an N-methoxymethylated 6-nylon resin (Mw=28,000) and 10 g of an alcohol-soluble copolymer nylon resin (Mw=27,000) in a mixture solvent of 45 g of methanol and 60 g of butanol was applied by dipping, followed by drying to form a 1 micron-thick undercoating layer.

Subsequently, 5 g of a fluorene compound (2-30), 5 g of a triphenylamine compound (3-53) and 15 g of a bisphenol A-type polycarbonate resin (Mw=27,000) were dissolved in 100 g of a mixture solvent of monochlorobenzene/dichloromethane (3/7 by weight). The solution was applied onto the undercoating layer by wire bar coating and dried to form a CTL having a thickness of 15 μm.

Then, 57 g of an acrylate-type monomer of the formula:

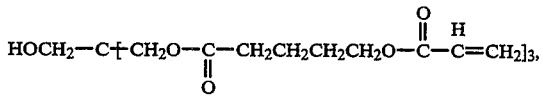

33 g of tin oxide fine particles having an average particle size of 400 521 (before dispersion), 2 g of 2-methylthioxanthone and 300 g of methyl cellosolve were mixed and stirred for 64 hours in a sand mill. The resultant mixture was applied onto the CTL and cured by photopolymerization for 30 seconds with a high-pressure mercury lamp (light intensity of 8 mW/cm$^2$; irradiation distance of 25 cm) to form a 2.7 μm-thick protective layer, whereby a testing structure for evaluation of a crack and crystallization was prepared.

The testing structure was subjected to observation of occurrence of a crack and crystallization with a transmission microscope (magnification: 50) as follows.

From the back side (the glass substrate side) of the testing structure, light was emitted to the photosensitive member so as to form an incident angle (i.e., an angle formed by light arriving at the surface of the glass plate and the perpendicular to that surface at the point of arrival) of 75 degrees. Occurrence of a crack or crystallization was evaluated from a state of the CTL.

EXAMPLES 5-43 TO 5-47 AND COMPARATIVE EXAMPLES 5-23 TO 5-26

Testing structures were prepared and evaluated in the same manner as in Example 5-42 except for using compounds in the indicated proportions shown in Table 29 instead of 5 g of the fluorene compound (2-30) and 5 g of the triphenylamine compound (3-53), respectively.

The results are shown in Table 29 below.

TABLE 29

| | Ex. Comp. | Crack | Crystallization |
|---|---|---|---|
| Ex. | | | |
| 5-42 | No. (2-30) 5 g<br>No. (3-53) 5 g (mp. 149° C.) | Not observed | Not observed |
| 5-43 | No. (2-25) 7 g<br>No. (3-11) 3 g (mp. 99° C.) | Not observed | Not observed |
| 5-44 | No. (2-25) 6 g<br>No. (3-43) 4 g (mp. 137° C.) | Not observed | Not observed |
| 5-45 | No. (2-30) 7 g<br>No. (3-3) 3 g (mp. 63° C.) | Not observed | Not observed |
| 5-46 | No. (2-29) 8 g<br>No. (3-12) 2 g (mp. 100° C.) | Not observed | Not observed |
| 5-47 | No. (2-43) 9 g<br>No. (3-1) 1 g (mp. oily) | Not observed | Not observed |
| Comp. Ex. | | | |
| 5-23 | No. (3-62) 7 g<br>No. (3-11) 3 g (mp. 99° C.) | Observed | Observed |
| 5-24 | No. (3-68) 8 g<br>No. (3-12) 2 g (mp. 100° C.) | Observed | Observed |
| 5-25 | No. (2-25) 6 g<br>No. (3-75) 4 g (mp. 195° C.) | Observed | Not observed |
| 5-26 | No. (2-29) 7 g<br>No. (3-68) 3 g (mp. 181° C.) | Observed | Observed |

As described hereinabove, according to the present invention, there is provided an electrophotographic photosensitive member characterized by a photosensitive layer containing a fluorene compound of the formula (1) or containing a fluorene compound of the formula (2) and a triphenylamine compound of the formula (3) having a melting point (m.p.) of at most 160° C. The photosensitive member shows a high photosensitivity and a decreased potential stability in respect of a light part potential and a dark part potential when used in a continuous image formation by a repetitive charging and exposure, etc., thus being excellent in a durability. The photosensitive member also shows a decreased transfer memory when used in a reversal development system and is substantially free from a crack in the photosensitive layer and a crystallization of a charge-transporting material resulting in image defects.

What is claimed is:

1. An electrophotographic photosensitive member, comprising: an electroconductive support and a photosensitive layer disposed on the electroconductive support, wherein said photosensitive layer contains (i) a fluorene compound of the following formula (2):

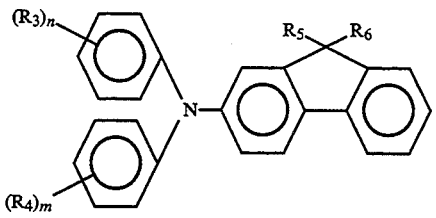

(2)

wherein $R_3$, $R_4$, $R_5$ and $R_6$ independently denote hydrogen atom or alkyl group, and n and m independently denote 1 or 2 with the proviso that $R_3$, $R_4$, $R_5$ and $R_6$ cannot be hydrogen atom simultaneously and (ii)

a triarylamine compound of the following formula (3) having a melting point of at most 160° C:

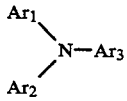

(3)

wherein $Ar_1$, $Ar_2$ and $Ar_3$ independently denote aryl group or heterocyclic group, said triarylamine compound being different from said fluorene compound of the formula (2).

2. A photosensitive member according to claim 1, wherein said photosensitive layer comprises a charge generation layer and a charge transport layer.

3. A photosensitive member according to claim 2, wherein said charge transport layer contains said fluorene compound and said triarylamine compound.

4. A photosensitive member according to claim 2, wherein said electroconductive support, said charge generation layer and said charge transport layer are disposed in this order, and said charge transport layer contains said fluorene compound and said triarylamine compound.

5. A photosensitive member according to claim 1, further comprising an undercoating layer disposed between said electroconductive support and said photosensitive layer.

6. A photosensitive member according to claim 1, further comprising a protective layer disposed on said photosensitive layer.

7. An electrophotographic apparatus, comprising: an electrophotographic photosensitive member according to claim 1, means for forming an electrostatic latent image, means for developing the formed electrostatic latent image and means for transferring the developed image to a transfer-receiving material.

8. A device unit, including: an electrophotographic photosensitive member according to claim 1 and at least one means selected from a charging means, a developing means, and a cleaning means;

wherein said photosensitive member, and said at least one means selected from the charging means, the developing means, and the cleaning means are integrally supported to form a single unit, which can be connected to or released from an apparatus body as desired.

* * * * *

UNITED STATES PATENT AND TRADEMARK OFFICE

CERTIFICATE OF CORRECTION

PATENT NO. : 5,415,962

DATED : May 16, 1995

INVENTOR(S) : TETSURO KANEMARU, ET AL.

It is certified that error appears in the above-indentified patent and that said Letters Patent is hereby corrected as shown below:

COLUMN 4

Line 25, "triaylamine" should read --triarylamine--.
Line 27, "view" should read --view of--.

COLUMN 48

Line 66, "connected" should read --connected to--.

COLUMN 49

Line 1, "carries" should read --carriers--.
Line 7, "carries" should read --carriers--.
Line 53, "drum" should read --drum 1--.
Line 57, "drum" should read --drum 1--.
Line 61, "drum" should read --drum 1--.

COLUMN 63

Line 45, "or" should read --a--.

COLUMN 65

Line 68, "provided" should read --provided good electro-photographic characteristics and were substantially free from a crack in a photo-sensitive layer and a crystallization of a CTM compared with those of Comparative Examples.--.

UNITED STATES PATENT AND TRADEMARK OFFICE

CERTIFICATE OF CORRECTION

PATENT NO. : 5,415,962

DATED : May 16, 1995

INVENTOR(S) : TETSURO KANEMARU, ET AL

It is certified that error appears in the above-indentified patent and that said Letters Patent is hereby corrected as shown below:

COLUMN 72

Line 26, "400 521" should read --400 A--.

Signed and Sealed this

Twenty-ninth Day of August, 1995

Bruce Lehman

*Attest:*

BRUCE LEHMAN

*Attesting Officer*

*Commissioner of Patents and Trademarks*